US005797068A

United States Patent [19]

Otsuki et al.

[11] Patent Number: 5,797,068

[45] Date of Patent: Aug. 18, 1998

[54] COMPACT IMAGE FORMATION APPARATUS FACILITATING JAM REMOVAL

[75] Inventors: Naohito Otsuki; Kyoji Kamei; Akiyoshi Inoue; Kiyoshi Ishikawa; Shin Sakurai; Takuo Matsumura, all of Ebina, Japan

[73] Assignee: Fuji Xerox Co., Ltd., Tokyo, Japan

[21] Appl. No.: 706,252

[22] Filed: Sep. 4, 1996

[30] Foreign Application Priority Data

Sep. 5, 1995 [JP] Japan ..... 7-228294
Aug. 19, 1996 [JP] Japan ..... 8-217663

[51] Int. Cl.[6] ..... G03G 15/00

[52] U.S. Cl. ..... 399/110; 271/9.01; 399/124

[58] Field of Search ..... 399/110, 124, 399/361, 364, 401, 125; 271/9.01, 9.11

[56] References Cited

U.S. PATENT DOCUMENTS

| | | | |
|---|---|---|---|
| Re. 35,341 | 10/1996 | Kikuchi et al. | 271/9.01 X |
| 4,110,030 | 8/1978 | Knechtel | 399/364 X |
| 5,086,320 | 2/1992 | Koike | 399/401 |
| 5,102,112 | 4/1992 | Takahashi | 271/9.11 X |
| 5,485,990 | 1/1996 | Kato | 271/9.11 X |
| 5,659,846 | 8/1997 | Yoshioka | 399/364 X |

FOREIGN PATENT DOCUMENTS

| | | |
|---|---|---|
| 53-127727 | 11/1978 | Japan . |
| 2-68574 | 3/1990 | Japan . |
| 2-127685 | 5/1990 | Japan . |
| 5-338832 | 12/1993 | Japan . |
| 6-3892 | 1/1994 | Japan . |
| 6-161183 | 6/1994 | Japan . |
| 6-186800 | 7/1994 | Japan . |

*Primary Examiner*—S. Lee
*Attorney, Agent, or Firm*—Oliff & Berridge PLC

[57] ABSTRACT

A compact image formation apparatus forms an image on an image support, discharges the image support supporting an image to an outside of the apparatus and facilitates jam removal. The image formation apparatus has all operation portions for performing operations from the outside of the image formation apparatus located on three operation faces including a top face, a front, and either a left side face or a right side face of the image formation apparatus. A rear face and the other of the left side face or right side face of the image formation apparatus are set to be non-operation faces.

29 Claims, 20 Drawing Sheets

COMPACT IMAGE FORMATION APPARATUS FACILITATING JAM REMOVAL

BACKGROUND OF THE INVENTION

This invention relates to an image formation apparatus such as a copier, a printer, or a facsimile and in particular to an image formation apparatus whose main unit can have the rear face and either the left or right side face placed adjoining walls of a room.

Hitherto, the viewpoints of excellent quality of formed images, excellent productivity at fast image formation speed, excellent operability of easy handling, apparatus miniaturization, etc., have been positioned as important factors on design of image formation apparatuses including electrophotographic copiers; the image formation apparatuses have been designed less considering the installation place and space except for apparatus miniaturization.

For example, disclosed in Japanese Patent Laid-Open No. Hei 2-68574 is a multiple transfer type image formation apparatus comprising a paper transport passage 7 capable of transporting paper in response to a double-sided copy mode or single-sided composite copy mode selected in addition to a normal paper transport channel in an apparatus housing 1, as shown in FIG. 18. In the apparatus, an automatic original document feeder 47 is placed on a top face 1*a* of the apparatus housing 1, paper feed cassettes 48 and a manual paper feed tray 49 are placed at positions protruding from a right side face 1*b* of the apparatus, a copy paper outlet 4 comprising a discharge roll is opened in a left side face 1*c* of the apparatus, and a discharge tray 50 is placed at a position protruding from the left side face 1*c*.

In the apparatus comprising the paper transport channel, although not shown or described, for jam removal operation for solving jam trouble occurring in the paper transport channel, normally if a jam occurs on a supply transport passage via which paper is supplied to a transfer position of an image formation unit 8, the paper feed cassette 48 is taken out for removing the jam from the right side face 1*b* of the apparatus on which the paper feed cassette 48 is placed; if a jam occurs on a transport passage from the image formation unit 8 through a fixing device 9 to a discharge transport passage or a transport passage positioned at the center of the apparatus housing 1 where when a double-sided copy or single-sided composite copy is made, paper passes through or is temporarily stored, the jam is removed from the front of the apparatus; or if a jam occurs on the discharge transport passage or a transport passage placed at a position adjoining the left side face 1*c* of the apparatus where when a double-sided copy or single-sided composite copy is made, paper passes through, the jam is removed from the left side face 1*c* of the apparatus. The left and right side faces 1*b* and 1*c* as well as the top face 1*a* and the front of the apparatus serve as operation faces for handling the apparatus from the outside, such as performing copy operation of setting an original document, selecting a copy mode of the apparatus taking out copy paper, etc., and maintenance of removing a jam when it occurs, maintenance inspection of the image formation unit, fixing device, etc.

Proposed in Japanese Patent Laid-Open No. Hei 2-127685 is an apparatus wherein paper feed cassettes 48*a* and 48*b* are placed in the vicinity of the center in an apparatus housing 1 so that they do not protrude to the outside of the apparatus, as shown in FIG. 19. In the apparatus, a supply transport passage 51 of a paper transport channel is placed between the paper feed cassettes 48*a* and 48*b* and a right side face 1*b* of the apparatus and a discharge transport passage 52 of the paper transport channel and a reverse transport passage 53 used when a double-sided copy is made are placed between the paper feed cassettes 48*a* and 48*b* and a left side face 1*c* of the apparatus. Also in the apparatus, for example, if a jam occurs on the supply transport passage 51, it needs to be removed from the right side face 1*b* of the apparatus or if a jam occurs on the discharge transport passage 52 or the reverse transport passage 53, it needs to be removed from the left side face 1*c* of the apparatus. As in Japanese Patent Laid-Open No. Hei 2-68574, both the left and right side faces 1*b* and 1*c* of the apparatus as well as a top face 1*a* and the front of the apparatus serve as operation faces for handling the apparatus from the outside.

Further, proposed in Japanese Patent Laid-Open No. Hei 5-338832 is an apparatus wherein for paper feed cassettes 48*a* to 48*d* placed in an apparatus housing 1, a small-sized cassette is used as the paper feed cassette 48*a* at the top stage and is placed at a position not affected by paper transport of the paper feed cassettes 48*b*–48*d* for storing paper of the maximum size, as shown in FIG. 20. Also in the apparatus, a supply transport passage 51 of a paper transport channel is placed between the paper feed cassettes 48*a*–48*d* and a right side face 1*b* of the apparatus and a copy paper outlet 4 is placed in a left side face 1*c* of the apparatus. In any way, as in Japanese Patent Laid-Open No. Hei 2-68574, both the left and right side faces 1*b* and 1*c* of the apparatus as well as a top face 1*a* and the front of the apparatus serve as operation faces for handling the apparatus from the outside.

By the way, in such image formation apparatuses, to place not only the rear face of the apparatus, but also either the left or right side face of the apparatus adjoining walls of a room, operation faces of the apparatus are limited to the top face, the front, and either the left or right side face of the apparatus. Thus, various mechanisms for performing copy operation of setting an original document, selecting a copy mode of the apparatus, taking out copy paper, etc., and maintenance of removing a jam when it occurs, maintenance inspection of the image formation unit, fixing device, etc., must be distributed to the three operation faces for placement. Particularly for the paper transport channel, removing a jam when it occurs is indispensable; how it is designed is extremely important and difficult to accomplish.

Proposed as a method for facilitating removing a jam when it occurs on such a paper transport channel is a method wherein several means, devices, or portions in the main unit of the apparatus are put into a unit and the several means, devices, or portions put into a unit are drawn out from the main unit of the apparatus to the front for facilitating removing a jam when it occurs.

That is, proposed in Japanese Patent Laid-Open No. Sho 53-127727 is a method wherein a paper feed bed and a paper transport passage frame can be integrally drawn out from the main unit of a copier and the paper feed bed can be drawn out independently of the transport passage frames thereby enabling speedy and easy jam handling and maintenance and inspection.

Also, proposed in Japanese Patent Laid-Open No. Hei 6-3892 is a method wherein sheet discharge means, a sheet holding member, a sheet transport passage, and switch means for guiding a sheet on which an image is formed into the discharge means or again guiding the sheet into the transport passage are put into a unit, which can be drawn out from the apparatus main unit, accomplishing miniaturization of the apparatus and facilitating removal operation of a jam when the jam occurs.

Further, proposed in Japanese Patent Laid-Open No. Hei 6-161183 is a method wherein an intermediate tray for storing and stacking a sheet of paper having a single side on which data write is already made, transported via a reverse transport passage, paper introduction and discharge means for introducing and discharging a sheet of paper having a single side on which data write is already made, into and from the intermediate tray, paper refeed means attached to the intermediate tray, and a paper refeed transport passage for transporting a sheet of paper having a single side on which data write is already made, again fed via the paper refeed means and the paper introduction and discharge means to an image formation section are composed as an intermediate paper feed unit, thereby improving jam handling workability between the intermediate tray and the image formation section.

In addition, proposed in Japanese Patent Laid-Open No. Hei 6-186800 is a method wherein a parts unit including fixing means for fixing an unfixed toner image transferred onto a sheet material onto the sheet material, discharge means for discharging a sheet material onto which an unfixed toner image is fixed to the outside of the apparatus main unit, and reverse means for reversing a sheet material when both-sided image formation is executed is composed and can be drawn out to the outside of the apparatus main unit, so that a jam handling space on the paper discharge side face is made unnecessary.

Every prior art is to put several parts into a unit for facilitating jam removal operation when a jam occurs, but does not enable either the left or right side face of the apparatus as well as the rear face to be placed adjoining walls of a room and does not teach how a paper transport channel is designed for facilitating jam removal operation when a jam occurs, within the three limited operation faces of the top face, the front, and either the left or right side face of the apparatus main unit.

As described above, in conventional image formation apparatuses including those described in the gazettes (Japanese Patent Laid-Open Nos.), not only the top face and front of the apparatus, but also both the left and right side faces of the apparatus always become operation faces required for the operator to perform any operation from the outside of the apparatus; the side face of the apparatus cannot be placed adjoining the wall of a room because of the necessity for performing the operation. Resultantly, the installation place of the apparatus is greatly limited. Also, since an operation space must be provided on both the left and right sides of the apparatus an installation space near twice the size of the apparatus itself is required.

Then, from an elaborate study considering such viewpoints the inventor has developed an image formation apparatus which has all operation parts for the operator to perform operation from the outside of the apparatus placed as operation faces of the top face, the front, and either the left or right side face of the apparatus main unit and the rear face and the other side face of the apparatus main unit as non-operation faces, whereby the rear face and either the left or right side face of the apparatus main unit as non-operation faces can be placed adjoining the walls on the corners of a room, enables the operator to perform operation intensively from one of the top facet the front, and either the left or right side face of the apparatus main unit used as the operation faces, and is also excellent in operability, thereby completing the invention.

Accordingly, if the operation faces of the apparatus main unit are limited to the two faces of the top face and front, the room space where the apparatus is installed can be used more effectively, but it is not preferred to limit the operation faces to the two faces of the top face and front of the apparatus main unit because it becomes unreasonable to design the apparatus with respect to installation places of a paper outlet and an operation port for jam removal and installation positions of external devices such as a finisher.

SUMMARY OF THE INVENTION

It is therefore an object of the invention to provide an image formation apparatus that can be installed with the rear face and either the left or right side face of the apparatus placed adjoining walls at corners of a room, whereby an installation place of the apparatus is not much limited, the installation space of the apparatus can also be used efficiently, and operation such as feeding an original document into the apparatus and taking out copy paper therefrom can be preformed from the front and either the left or right side face of the apparatus, providing an image formation apparatus also excellent in operability.

It is another object of the invention to provide an image formation apparatus that can be miniaturized and comprises an image support transport channel enabling smooth transport of image supports typified by sheets of paper, OHP sheets, etc., even when the apparatus is installed adjoining walls of a room.

It is still another object of the invention to provide an image formation apparatus that can be installed adjoining walls of a room and enables easy removal of a jam when it occurs in an image support transport channel.

It is another object of the invention to provide a high-reliability image formation apparatus that can be installed adjoining walls of a room and can stably form high-quality images without sacrificing miniaturization of the apparatus or jam handling efficiency.

To these ends, according to a first aspect of the invention, there is provided an image formation apparatus which comprises image formation means for forming an image on an image support and discharges the image support supporting an image formed by the image formation means to an outside of the apparatus, characterized in that all operation portions for performing operation for the image formation apparatus from the outside of the apparatus are put together on three operation faces consisting of a top face, a front, and either a left or right side face of the apparatus and that a rear face and the other side face of the apparatus are set to non-operation faces.

In the first aspect of the invention, which of the left and right side faces is used as an operation face and is set to a non-operation face can be determined appropriately based on convenience of design, user demands based on a layout of a room, etc., generally most of operators seem to be right-handed persons, thus the right side face is used as an operation face and the left side face is set to a non-operation face.

Operation sections required for the operator to operate and maintain the apparatus from the outside thereof, such as copy operation of setting an original document, selecting a copy mode of the apparatus, taking out copy paper, etc., and maintenance of removing a jam when it occurs, maintenance inspection of the image formation unit, fixing device, etc. are put together on the top face, the front, and either the left or right side face used as operation faces.

The form wherein an original document is automatically fed for reading images to be formed further includes automatic original document feed means being disposed on the top face of the image formation apparatus with an automatic original document feed direction set from the side face used as an operation face to the side face set to a non-operation face and image input means for inputting an image of the original document automatically fed by the automatic original document feed means as the image, whereby when the operator sets an original document in the automatic original document feeder, walls positioned on the non-operation faces of the apparatus do not hinder the operator from doing it; good operability of setting original documents is provided. If the operation faces of the apparatus are limited to two faces of the top face and front of the apparatus, it is difficult to intend such improvement in operability.

According to a second aspect of the invention, there is provided an image formation apparatus for transferring an image provided by developing an electrostatic latent image formed on a photosensitive body to a sheet and discharging the sheet to an outlet made in one side face of an apparatus main unit, the image formation apparatus comprising means being disposed in a lower portion of the apparatus for storing the sheet, means for taking out the sheet from the storage means in a direction of the one side face on the one side face, first transport means for transporting the sheet taken out by the taking-out means to the other side face of the apparatus main unit, and main transport means being disposed in an upper portion of the apparatus for transporting the sheet from a downstream end of the first transport means to the outlet made in the one side face from the other face of the apparatus main unit to form an image on the sheet facing a photosensitive face of the photosensitive body, wherein an opening/closing section of the apparatus main unit for jam removal to solve jam trouble occurring in a sheet transport channel including the taking-out means, the first transport means, and the main transport means is disposed in the front and the one side face.

The sheet taking-out direction and discharging direction are matched on one side face of the apparatus main unit used as an operation face, the passage from taking out a sheet to discharging of the sheet is formed almost like an S letter, and the opening/closing section for jam removal is disposed on the front and the one side face, whereby when jam trouble occurs, jam removal can be executed easily and promptly from the operation face and the front without moving the entire apparatus and the distance required for transporting a sheet can be shortened; the width of the apparatus main unit can be shortened accomplishing miniaturization of the apparatus. Moreover, the main transport means required for image formation is disposed so as to transport sheets from the other side face of the apparatus main unit to the outlet made in the one side face, namely, sheets are transported almost horizontally, thus high-quality images can be formed with high reliability.

The preferred form further includes second storage means being disposed to the other side face above the storage means for storing smaller-sized sheets than maximum-sized sheets stored in the storage means and second taking-out means for taking out a sheet in the second storage means in a direction of the one side face and sending the sheet downstream of the first transport means. That is, a sheet taken out from the second storage means can be sent to the main transport passage while it simply flows through the downstream portion of the first transport means, so that image formation can be executed in a short time. For example, A3-size, B4-size, and any other size sheets of paper are stored in the storage means at the lower stage and A4-size sheets most frequently used are stored in the second storage means, whereby images can be formed on the A4-size sheets most frequently used in a short time, so that images can be formed efficiently on sheets of paper of different sizes.

The form for performing double-sided printing further includes reversing transport means branching from downstream of the main transport means and being disposed downstream along the one side face for reversing a sheet having a first side (for example, surface) on which an image is formed in order to support an image on a second side (for example, rear face) of the sheet, and second transport means for sending the sheet reversed by the reversing transport means to an upstream end of the main transport means in a direction of the other side face. That is, the reversing transport means and the second transport means are also disposed on the one side face used as an operation face, so that a jam can be easily removed from the opening/closing sections on the one side face and front.

Further, in the form wherein a postprocessing device such as a finisher having a function of a sorter, stapler, or a set holder is added to the image formation apparatus, for example, an outlet of an image support supporting an image is made protruding to the upper part of the side face used as an operation face and a space for jam removal may be provided between the postprocessing device being connected to the outlet and placed forward of a discharge direction, of the image support and the side face used as an operation face, whereby jam removal can be executed from the operation face without detaching and moving the finisher whenever a jam occurs.

Further, an air introduction port disposed in the apparatus for smoothly exhausting hot air occurring from the fixing device built in the apparatus to the outside of the apparatus and smoothing a flow of air occurring when the opening/closing section formed on the operation face of the apparatus is opened or closed, a power cord taking-out port for supplying electric power to the apparatus, and the like preferably are formed on the bottom of the apparatus assuming that the apparatus is installed adjoining walls at corners of a room.

According to a third aspect of the invention, there is provided an image formation apparatus for transferring an image formed on a photosensitive body to a sheet for forming an image and discharging the sheet on which the image is formed to an outlet made in one side face of an apparatus main unit, the image formation apparatus comprising means for storing sheets, means for taking out a sheet from the storage means in a direction of the one side face, first transport means for transporting the sheet taken out by the taking-out means to the other side face of the apparatus main unit, resist means for turning the sheet transported on the first transport means toward the direction of the one side face and positioning the sheet with respect to the photosensitive body, and main transport means for transporting the sheet to the outlet made in the one side face from the other face in order to perform the transferring and discharging for the sheet sent out from the resist means.

Thus, in the third aspect of the invention, the transport channel from taking out a sheet to discharging of the sheet is formed almost like an S letter as in the second aspect of the invention; however, since the sheet is diverted from the first transport means to the main transport means by the resist means, the apparatus device can be furthermore shortened as compared with the second aspect of the invention.

The form for performing double-sided printing further includes reversing transport means branching from downstream of the main transport means and being disposed along the one side face for transporting the sheet from the main transport passage in order to reverse an image formation side of the sheet having a first side on which an image is formed, and second transport means for transporting the sheet from the reversing transport means to the resist means. According to such a configuration, image formation processing transported from the first transport means and reversing of the image formation side of the sheet having a single side or both sides on which an image is formed can be performed at the same time, thus the effects as described above can be produced and various steps such as double-sided printing and face-up and face-down of the sheet on which an image is formed can also be performed efficiently.

According to a fourth aspect of the invention (claim 9), there is provided an image formation apparatus for transferring an image formed on a photosensitive body to a sheet for forming an image and discharging the sheet on which the image is formed to an outlet made in one side face of an apparatus main unit, the image formation apparatus comprising means for storing sheets, means for taking out a sheet from the storage means in a direction of the one side face, first transport means for transporting the sheet taken out by the taking-out means to the other side face of the apparatus main unit, resist means for turning the sheet transported on the first transport means toward the direction of the one side face and positioning the sheet with respect to the photosensitive body, and main transport means for transporting the sheet to the outlet made in the one side face from the other face in order to perform the transferring and discharging for the sheet sent out from the resist means, characterized by a unit into which the first transport means, the resist means, and the main transport means are put, and by means for drawing out the unit from the apparatus main unit to a front thereof.

The components are thus put into a unit, whereby all jams occurring in the transport channel consisting of the first transport means, the resist means, and the main transport means for which operation such as jam removal from the front is required can be removed from the outside of the unit and in addition, operation such as jam removal from the front can be performed at only one place of the unit without inspecting several places according to indication of jam position, etc., of the machine. Thus, the effect of the third aspect of the invention is produced and the effect of being able to perform operation such as jam removal easily, rapidly, and comfortably is also produced.

In the form for performing double-sided printing, the unit further includes reversing transport means branching from the main transport means and being disposed along the one side face for transporting the sheet from the main transport passage in order to reverse an image formation side of the sheet, and second transport means for transporting the sheet from the reversing transport means to the resist means. In addition to the above-mentioned effect, the effect described in the double-sided printing form in the third aspect of the invention can be produced. Also, jams occurring in the reversing transport means and the second transport means can be removed from the outside. Thus, the effect of being able to perform an operation such as jam removal furthermore efficiently is produced.

The preferred form having transfer control means further includes means for controlling transport of from taking out a sheet from the storage means to discharging the sheet, when sheet transport is interrupted due to an error, the control means for controlling the sheet transport so that the sheet being transported does not extend across the unit and the apparatus main unit. Such control is performed, whereby when the unit is drawn out from the apparatus main unit, sheets are not broken. Thus, in addition to the above-mentioned effect, the effect of being able to perform operation such as jam removal furthermore easily, rapidly, and comfortably is produced.

Further, in another form, the first transport means and the second transport means are made common. As a result of such a configuration, the transport channel is simplified and the height of the apparatus is lowered, so that the apparatus can be furthermore miniaturized without degrading the function of the apparatus.

If the transport channel is designed to be opened to the outside by putting components into a unit, jam removal can be executed easily from the outside. In the preferred form for this purpose, the first transport means, the main transport means, and the reversing transport means contain a transport passage for carrying sheets, and one or more paired of rolls between which a sheet is sandwiched for sending it are disposed along a sheet flow on the transport passage of the first transport means and the reversing transport means, inner ones of the rolls being fixed to the unit and outer rolls being able to be attached to and detached from the inner rolls for opening and closing the transport passage to an outside of the unit. That is, of the transport passages, at least the pair of rolls in the portion opened/closed to the outside is detached and opened to the outside. Thus, the sheet sandwiched between the paired rolls is not broken and can be furthermore easily taken out to the outside.

Further, in a preferred form of the unit, the second transport means contains a transport passage for carrying sheets, the main transport means comprises transfer means for performing the transferring upstream, separation means for separating a sheet to which an image is transferred by the transfer means from the photosensitive body, means for fixing the image formed on the sheet separated by the separation means, and after-separation transport passage for transporting the separated sheet between the separation means and the fixing means, and is disposed in a subunit frame so that the transfer means, the separation means, and the after-separation transport passage pivot to an inside of the unit so as to be set apart from the photosensitive body when the unit is drawn out, and pivot to an outside of the unit after the unit is drawn out, and one or more paired of rolls for sending sheets are disposed on the transport passage of the second transport means, inner ones of the rolls being fixed to the unit and outer rolls being able to be attached to and detached from the inner rolls for opening and closing the transport passage to the outside. Resultantly, the subunit frame pivots to the inside (namely, lower side). Thus, for example, when a jam occurs on the transfer means of the main transport means, the separation means, or the after-separation transport passage and a sheet is drawn out in a state in which it is sandwiched, the sheet can be prevented from being broken or damage to the photosensitive body, the transfer means, the separation means, etc., can be prevented. Since the subunit frame pivots to the outside (namely, upper side) and the transport passage of the second transport means can also be opened to the outside in a state in which the outer roll of the opening/closing portion is contained the sheet sandwiched between paired of rolls is not broken and can be furthermore easily taken out to the outside.

In a preferred form of the second transport means, the first transport means, the main transport means, and the reversing transport means contain a transport passage for carrying sheets, the second transport means branches downstream of the transport passage of the reversing transport means and merges with downstream of the transport passage of the first transport means, and the transport passage of the main transport means, a transport passage portion before branch on the transport passage of the reversing transport means, and the transport passage of the second and first transport means are disposed like a Z letter. They are thus formed like a Z letter, whereby the length of the transport passage of the second transport means required for performing image formation processing and reversing of the image formation side efficiently at the same time can be provided as the minimum distance, so that the unit can be compacted. Therefore, the apparatus can be furthermore miniaturized.

In a preferred form concerning positioning of the unit with respect to the apparatus main unit, the unit comprises the first transport means, the resist means, and the main transport means disposed in a frame, the drawing-out means is a rail being disposed in the apparatus main unit and the frame for sliding the frame back and forth with respect to a cabinet of the apparatus main unit, and positioning between the resist means and the photosensitive body is performed by fitting pins disposed in the unit into holes made in the cabinet of the apparatus main unit. According to such a configuration, the resist means can be accurately positioned.

In a preferred form concerning positioning of the fixing means of the unit, the unit contains means for fixing an image on a sheet after the transferring, the fixing means being disposed with play in the unit, and wherein positioning is performed by fitting pins disposed in a cabinet of the fixing means into holes made in the cabinet of the apparatus main unit. The resist means and the fixing means can be positioned separately and moreover easily.

In a preferred form of the resist means and the fixing means of the unit, the resist means and the fixing means are attached as subunits detachable from the frame of the unit and the subunit of the fixing means is disposed with play detachably with pins disposed upward at attachment positions of the frame of the unit and holes made in a lower part of the cabinet of the fixing means. That is, the frame pins of the unit are simply inserted into the holes in the bottom of the cabinet of the fixing means, whereby the fixing means can be easily installed by a loose fit and accurate positioning can be performed.

In a preferred form of the resist means in the third and fourth aspects of the invention, the resist means includes a turn transport passage for turning from a connection part to a downstream end of the first transport means to connection of an upstream end of the main transport means like a half circumference, a first roll being disposed downstream of the transport passage for aligning a sheet for the transferring, a second roll being disposed upstream of the turn transport passage for sending a sheet fed into the turn transport passage to a loop formation area between and a resist position near the first roll, means being disposed near the resist position for detecting a tip of a sheet, and baffle means taking a first position for sending the sheet to the resist position like a half circumference along the turn transport passage until the detection means detects the tip of the sheet and a second position for opening a transport passage of a portion of the loop formation area as large as a loop size to an outside at least during loop formation so that the sheet makes a loop in the loop formation area when the detection means detects the tip of the sheet. According to such a configuration, the baffle means enables accurate and reliable positioning by the bent turn transport passage.

According to a fifth aspect of the invention, there is provided an image formation apparatus for transferring an image formed on a photosensitive body to a sheet for forming an image and discharging the sheet on which the image is formed to an outlet made in one side face of an apparatus main unit, the image formation apparatus comprising a unit comprising means for storing sheets, means for taking out a sheet from the storage means in a direction of the one side face, first transport means for transporting the sheet taken out by the taking-out means to the other side face of the apparatus main unit, resist means for turning the sheet transported on the first transport means toward the direction of the one side face and positioning the sheet with respect to the photosensitive body, main transport means for transporting the sheet to the outlet made in the one side face from the other face in order to perform the transferring and discharging for the sheet sent out from the resist means, reversing transport means branching from downstream of the main transport means and being disposed along the one side face for transporting the sheet from the main transport passage in order to reverse an image formation side of the sheet, and second transport means for transporting the sheet from the reversing transport means to the resist means, and means for drawing out the unit from the apparatus main unit to a front thereof, wherein the unit is disposed in an upper portion of the apparatus main unit and a front door is disposed on a front of the apparatus main unit in order to remove a jam occurring in the upper portion, wherein one or more the storage means are disposed in a lower portion of the apparatus main unit and the taking-out means disposed corresponding to the storage means includes handling means for sending out stored sheets one at a time in sequence to the one side face and a paper feed transport passage for sending upward the sheets sent out from the handling means to the first transport passage, and wherein a side door is disposed on the one side face in order to remove a jam occurring in the taking-out means in the lower portion or the reversing transport means.

According to such a configuration, in addition to the effects of the third and fourth aspects of the invention, operation such as jam removal in the upper portion can be executed easily and rapidly by opening the front door and drawing out the unit and operation such as jam removal in the lower portion can be executed easily and rapidly by opening the side door.

In a preferred form of the side door, the reversing transport means contains an upper reversing transport passage for carrying sheets in the unit and a lower reversing transport passage being connected to the upper reversing transport passage and extending to the outside of the unit and the side door is a double door consisting of a first door (outer) for removing a jam on the lower reversing transport passage of the reversing transport means and a second door (inner) for removing a jam on the paper feed transport passage. Therefore, a jam occurring on the paper feed transport passage at the depth of the lower reversing transport passage can also be removed easily. Further preferably, the first and second doors are locked by lock means and when the first door is opened, the two doors are opened at the same time and when the lock is unlocked, the second door is opened.

Further, in a preferred form of the double door, the paper feed transport passage is disposed in a vertical direction and comprises one or more paired rolls disposed along a sheet flow, inner ones of the rolls being disposed in the apparatus main body and outer ones being disposed in the second door. Since the second door itself forms a part of the paper feed transport passage, the apparatus can be miniaturized in the width direction and sheets can be taken out easily and rapidly without being broken.

Further, in a preferred form of the double door, means for sandwiching a sheet temporarily in a state in which the sheet is dangled downward is disposed downstream of the upper reversing transport means disposed in the unit, and a space for temporarily storing the sheet sandwiched by the sandwich means is formed between the first and second doors as the lower reversing transport passage in a state in which the first and second doors are closed. That is, the lower reversing transport passage is used as a passage of the sheet dangled with paired rolls of the sandwich means, preferably, serving also as transport means, thus the reversing transport means can be simplified and the passage is formed between the first and second doors of the double door, so that the apparatus can be furthermore miniaturized in the width direction and sheets can be taken out easily and rapidly without being broken.

Another form further includes second storage means being disposed to the other side face between the first transport means in the upper portion and the storage means in the lower portion for storing smaller-sized sheets than maximum-sized sheets stored in the storage means, and second taking-out means for taking out a sheet from the second storage means in a direction of the one side face and sending the sheet to the first transport means. Since the transport distance to the resist means can be shortened, image formation productivity of sheets stored in the second storage means can be raised.

In a preferred form of the second taking-out means, the resist means includes a turn transport passage for turning from a connection part to a downstream end of the first transport means to connection of an upstream end of the main transport means like a half circumference and has a resist position for positioning a sheet for the transferring near a downstream end of the turn transport passage, and the second taking-out means includes second handling means for sending out stored sheets one at a time in sequence to the one side face and a second paper feed transport passage being shaped like a half circumference in a direction opposite to the turn transport passage for sending upward the sheets sent out from the second handling means to the first transport passage, and a continuous form of the turn transport passage, the first transport passage, and the second paper feed transport passage is formed like an S letter. Since the transport passage length can be maximized with a small space by forming such an S-shaped passage, the distance required for steps from taking out a sheet to transporting the sheet to the resist position can be minimized, and a jam can be made hard to occur because the curve is moderate. Therefore, the apparatus can be miniaturized without degrading the function, image quality, or reliability.

In a preferred form of the storage means, at least one of the storage means and the second storage means stores different types of sheets in corresponding placement means and the taking-out means sends the sheets placed in the selected placement means one at a time in sequence. That is, such a multitray technique enables images to be formed on various kinds of small-quantity sheets without using any manual paper feed trays, etc. Also in this case, the invention can embody placement of the apparatus adjoining walls at corners of a room.

According to a sixth aspect of the invention, there is provided an image formation apparatus wherein operation portions for performing operation for the image formation apparatus from an outside of the apparatus are put together on three operation faces consisting of a top face, a front, and either a left or right side face of the apparatus, the image formation apparatus comprising an original document placement section disposed on the top face, a section for reading an original document placed on the original document placement section, an image formation process section for forming an image read through the original document read section on a sheet and transporting the sheet in an almost horizontal direction, a registration section containing a reversing transport passage for diverting a transport direction of a sheet to one side face used as an operation face from one side face set to a non-operation face, the registration section for positioning the diverted sheet and then sending it to the image formation process section, a sheet transport passage containing a reversing transport passage for diverting a transport direction of a sheet to the one side face set to the non-operation face from the one side face used as the operation face, the sheet transport passage for sending the diverted sheet to the registration section, and a section for storing sheets fed into the sheet transport passage, wherein a sheet sending out direction from the sheet storage section and a sheet discharge direction to the outside of the apparatus are set to the one side face used as the operation face. For example, if the image formation process section is an electrophotographic apparatus, it includes transfer means, which is opposed to the photosensitive body, for transferring an image provided by developing an electrostatic latent image formed on a photosensitive body corresponding to an input image to a sheet, separation means for separating the sheet to which the image is transferred by the transfer means from the photosensitive body, fixing means, and transport means between the separation means and the fixing means.

The sections are thus placed, whereby the apparatus can be installed adjoining walls at corners of a room and moreover can be miniaturized without lowering operability of jam removal, image quality, or image formation productivity.

Another form further includes a small-sized sheet storage section being disposed between the registration section and the sheet storage section for storing smaller-sized sheets than sheets stored in the sheet storage section.

The form for performing double-sided printing, etc., further includes an image formation side reversing transport passage being disposed between and the sheet transport passage along the one side face used as the operation face for reversing a sheet transported from the image formation process section and having a single side on which an image is formed and a second transport passage being disposed between the sheet transport passage and the image formation processing section for transporting the sheet from the image formation side reversing transport passage to the registration section.

In a form of the transfer channel, the sheet transport passage from the sheet storage section and the small-sized sheet storage section to a sheet outlet of the apparatus is shaped substantially like an S letter.

In a form for facilitating jam removal, the image formation process section includes transfer means, fixing means, and a transport passage, wherein the transfer means, the fixing means, the transport passage, the registration section, and a part of the sheet transport passage are put into a unit, and wherein the fixing means and the registration section are positioned detachably from the unit as subunit.

DETAILED DESCRIPTION OF THE PREFERRED EMBODIMENTS

Referring now to the accompanying drawings, there are shown preferred embodiments of the invention.

Embodiment 1

Figure 1:
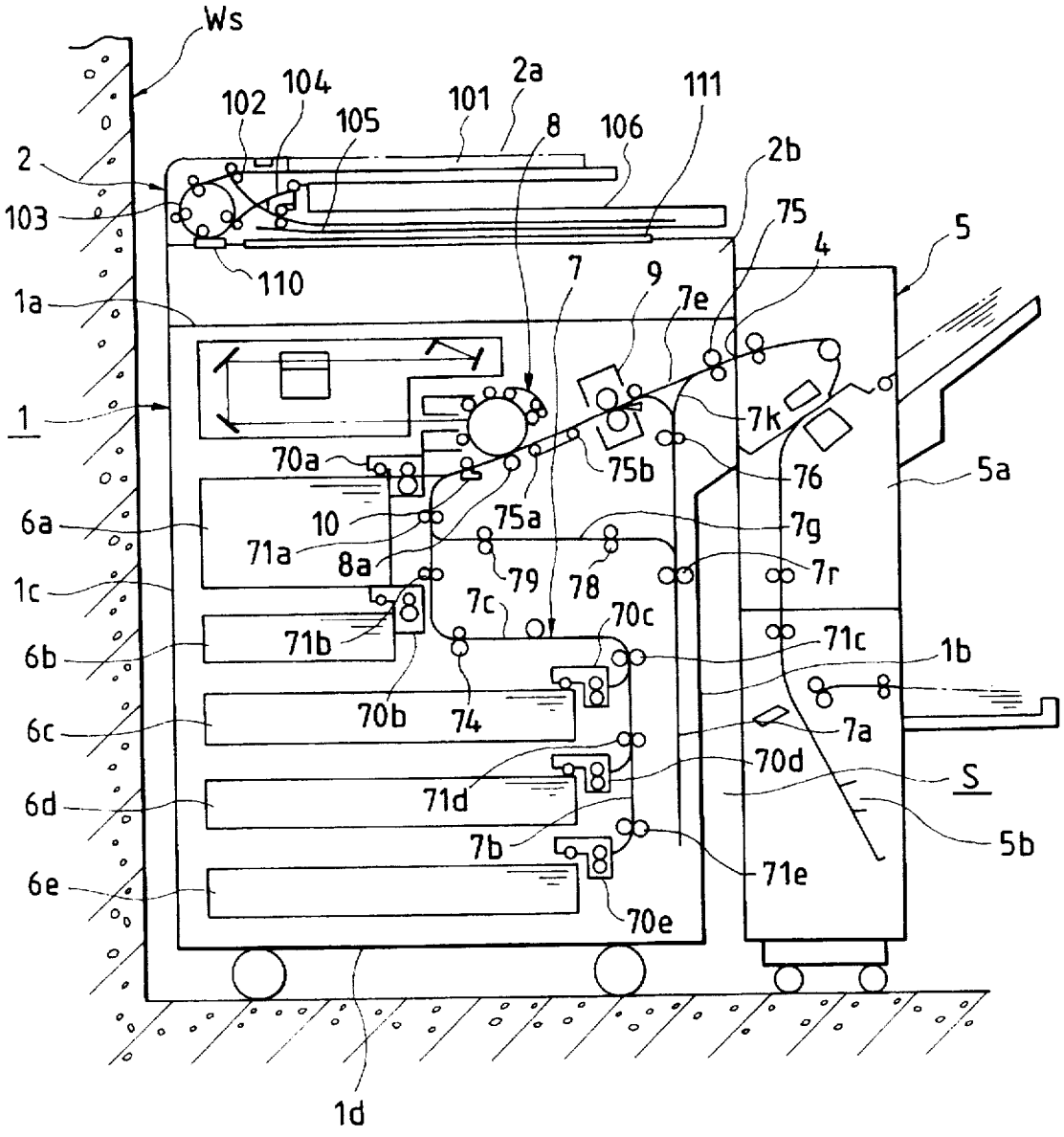
FIG. 1 is an illustration to show the inside of the front of a digital copier of a first embodiment to which the invention is applied.
Figure 2:
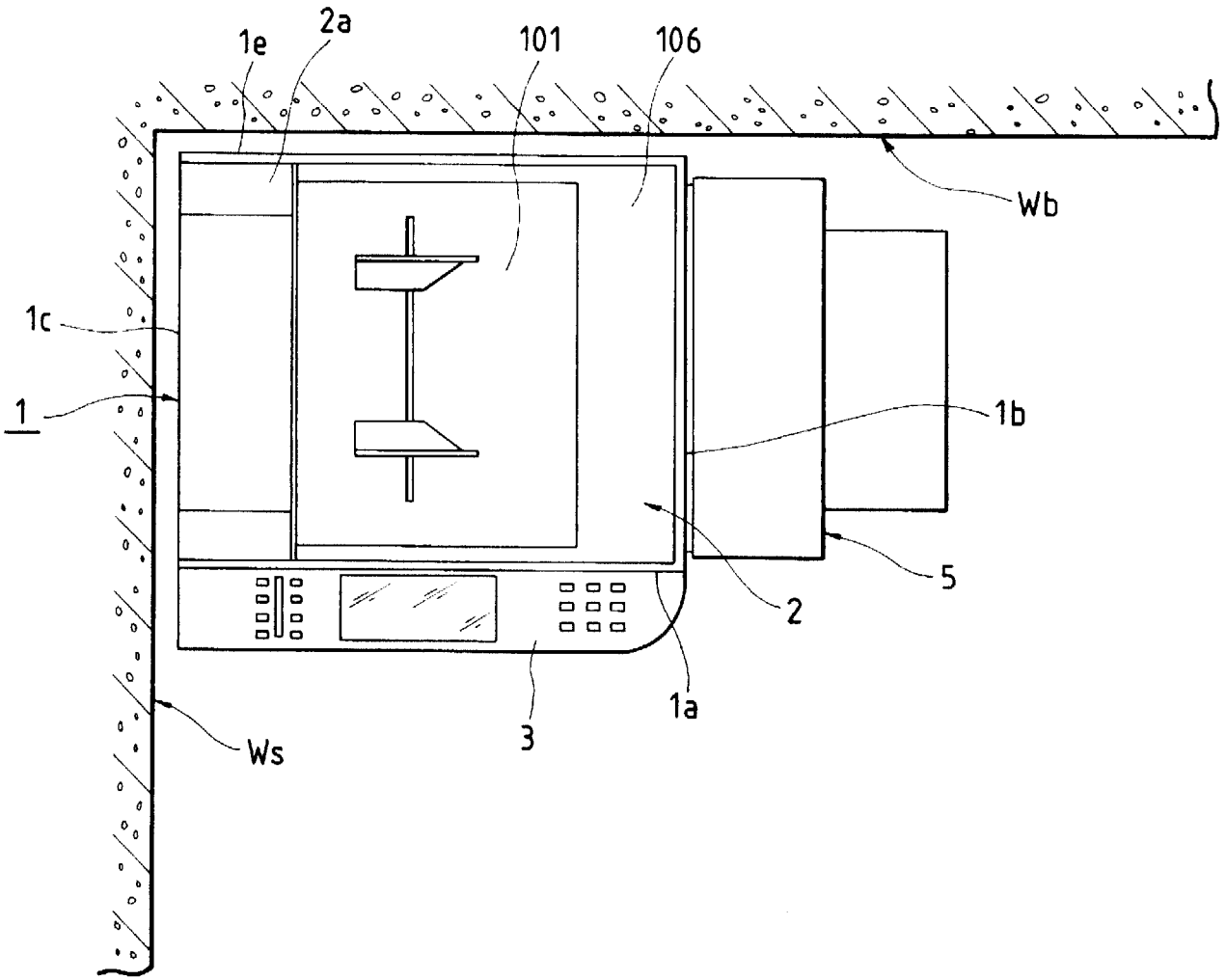
FIG. 2 is an illustration to show a plan view of FIG. 1.

FIGS. 1 and 2 show an example of a digital electrophotographic copier, which will be hereinafter referred to as the digital copier, according to a first embodiment to which the invention is applied.

The digital copier has an image input terminal (IIT) 2 comprising an automatic original document feed mechanism (ADF) and an original document scanning type read mechanism (CVT) and an operation panel 3 for operating the digital copier, which are installed on a top face 1*a* of an apparatus housing 1, and is formed with an outlet 4 of image supports such as paper and films on which images are supported (simply paper) on a right side face 1*b* in a state in which the outlet 4 protrudes from the general face of the right side face 1*b*. A predetermined space S is formed between the outlet 4 and a finisher 5 connected thereto consisting of a stapler 5*a* and a set holder 5*b*.

In the digital copier, as shown in FIG. 1, in a paper transport channel formed in the apparatus housing 1, both the paper sending direction of all storage cassettes 6*a*–6*e* for storing paper and the paper discharge direction of the outlet 4 for discharging image supporting paper to the outside of the apparatus housing 1 are directed toward the right side face 1*b* of an operation face from a left side face 1*c* of a nonoperation face; a paper transport passage 7 formed in the apparatus housing 1 is formed like substantially an S letter from the paper sending direction of the storage cassettes 6*a*–6*e* via a transfer device 8*a* of an image formation unit 8 to the paper discharge direction at the outlet 4 of the apparatus housing 1.

Large-sized storage cassettes 6*c*–6*e* for storing comparatively large-sized paper are placed at lower positions of the apparatus housing 1 and small-sized storage cassettes 6*a* and 6*b* for storing comparatively small-sized paper are placed at positions retreating to the left side face 1*c* of a nonoperation face above the large-sized storage cassettes 6*c*–6*e*. Both the paper sending direction of the large-sized storage cassettes 6*c*–6*e* and that of the small-sized storage cassettes 6*a* and 6*b* are directed toward the paper discharge direction of the outlet 4 and the transfer device 8*a* of the image formation unit 8 is placed at an upper position forward of the paper sending direction of the small-sized storage cassettes 6*a* and 6*b*.

That is, the cassettes 6*a* to 6*e* send sheets of paper one at a time to the right side face 1*b* by handling means 70*a* to 70*e* each containing a pickup roll disposed above sheets of paper such as stacked paper and OHP sheets and a pair of double sending prevention rolls, and the sent sheets are guided into the transport passage 7 by paired rolls 71*a* to 71*e* for transport. In the embodiment, since a resist part 10 for positioning a sheet with respect to a photosensitive body and the transfer device 8*a* exists in an upper-right portion near the cassette 6 at preferably a pair of rolls 71*a* also serves as rolls of the resist part 10. Sheets taken out from the cassettes 6*c*–6*e* are sandwiched between the rolls 71*c*–71*e* and proceed upward on the most downstream portion (transport passage 7*b*) along the S-shaped transport passage 7, then are diverted to the left, proceed on a transport passage 7*c*, again proceed upward by paired rolls 71*a* and 71*b* via a pair of rolls 74, are diverted to the right, and arrive at the resist part 10. Likewise, sheets taken out from the cassettes 6*a* and 6*b* proceed on the transport passage 7 and arrive at the resist part 10. Sheets positioned at the resist part 10 proceed on the transport passage 7 (transport passage 7*e*) almost horizontally. A sheet onto which an image on the photosensitive body of the image formation unit 8*a* is transferred by a separator. The sheet transferred by the transfer device 8*a* is separated from the photosensitive body, for example, by rolls 75*a* and 75*b*, and is sucked by and transported on a conveyor belt having a suction hole to the fixing device 9. The sheet fixed by the fixing device 9 and completing the image formation process is discharged via the pair of rolls 75 to the outlet 4.

For both-sided printing or to change the face, in the embodiment, the transport passage 7 has a reversing transport passage 7*a* containing transport passages 7*r*, 7*g*, and 7*k*. A sheet having a single side on which an image is formed is sent to the reversing transport passage 7r disposed downwardly along the right side face 1b branching downstream from the transport passage 7e, is sandwiched between a pair of rolls 76 and transported thereby, and is temporarily sandwiched between a pair of rolls 7r. To change the face, the sheet is transported upward, is diverted to the right on the transport passage 7k, and is discharged to the outlet 4. For both-sided printing, likewise the sheet is transported upward on a transport passage 7g branching from the reversing transport passage 7r above the pair of rolls 7r to the resist part 10 by pairs of rolls 78 and 79.

The paper stored in the small-sized storage cassette 6a at the highest position in the apparatus housing 1 is transported comparatively linearly on the paper transport passage 7, thereby suiting transport of comparatively thick paper and also serving as an alternative to the manual paper feed tray function.

In the digital copier, jam trouble occurring on the paper transport passage 7 basically can be handled by opening a side door (not shown) formed on the right side face 1b of an operation face for jam removal operation or a front door (not shown) for maintenance inspection of the image formation unit 8, the fixing device 9, etc. Further, an air introduction port (not shown) for exhausting hot air occurring in the apparatus housing 1 and absorbing a flow of air occurring when a door attached to the apparatus housing 1 is opened or closed and a power cord taking-out port (not shown) are formed on a bottom 1d of the apparatus housing 1.

The automatic original document feed mechanism (ADF) of the image input terminal 2 disposed on the top face 1a of the apparatus housing 1 is designed for setting an original document from the direction of the right side face 1b of an operation face of the apparatus housing 1 toward the direction of the left side face 1c of a non-operation face and feeding the original document to the left side face 1c of a non-operation face, then causing the original document to make a U-turn and discharging it from the left side face 1c toward the direction of the right side face 1b.

That is, to read an original document in an automatic feed mode through an automatic original document feeder 2a of the image input terminal 2, when the operator places the original document on a placement bed 101, for example, with the read face up, in the single-side read mode, the first page on the top of the placed original document is transported on a transport passage 102 in the direction of the left side face 1c from the right side face 1b and further transported on a transport passage 103 in the reverse direction, whereby it is read by a one-dimensional image sensor, such as a CCD image sensor. The read original document is discharged on a transport passage 104 to an original document discharge tray 106 disposed below the placement bed 101. Likewise, pages from the second page to the last page on the bottom of the document are read in sequence.

In the double-side read mode, first a single side of the original document is transported to the read position of the image sensor 110 and is read by the image sensor 110 as in the single-side read mode. After this, the read document is transported to a transport passage 105 disposed below the original document discharge tray 106, then again sent upstream of the transport passage 103, whereby the already read face becomes an inside and the opposite face to be newly read becomes an outside and the document proceeds downstream on the transport passage 103 and is read by the image sensor 110 at the read position.

On the other hand, to read an original document one sheet at a time, for example, a front knob of a cabinet of the automatic original document feeder 2a is lifted up, whereby the cabinet of the automatic original document feeder 2a pivotally supported on the depth of the image formation apparatus is pivoted upward and a platen 111 for placing an original document appears on the top face of a scanner 2b disposed on the top face 1a of the apparatus housing 1. When the operator places the original document on the platen 111, the scanner 2b scans the original document face on the platen 111 for reading the original document.

The image thus read is written onto a photosensitive body of the image formation unit 8 according to a known technique and an electrostatic latent image is formed on the photosensitive body and developed by a developing device.

Therefore, as shown in FIGS. 1 and 2, the digital copier can be installed with the left side face 1c and the rear face 1e of non-operation faces of the apparatus housing 1 adjoining a side wall face Ws and a rear wall face Wb respectively. All operation to be performed for the digital copier from the outside thereof, such as copy operation of setting an original document, selecting a copy mode of the apparatus, taking out copy paper, etc., and maintenance of removing a jam when it occurs, maintenance inspection of the image formation unit, fixing device, etc., can be executed from the top face 1a of the apparatus housing 1, the front (not shown), and the right side face 1b.

In the example, the right side face 1b of the apparatus housing 1 is used as an operation face and the left side face 1c is set to a non-operation face and the automatic document feed direction of the automatic original document feed mechanism is matched with the direction from the right side face 1b toward the left side face 1c, thereby facilitating operation for the digital copier with operator's right hand. However, the right side face 1b can be set to a non-operation face and the left side face 1c can be used as an operation face and the automatic document feed direction of the automatic original document feed mechanism can be set to the direction from the left side face 1c toward the right side face 1b, thereby facilitating operation for the digital copier with operator's left hand, as required.

Embodiment 2

Figure 3:
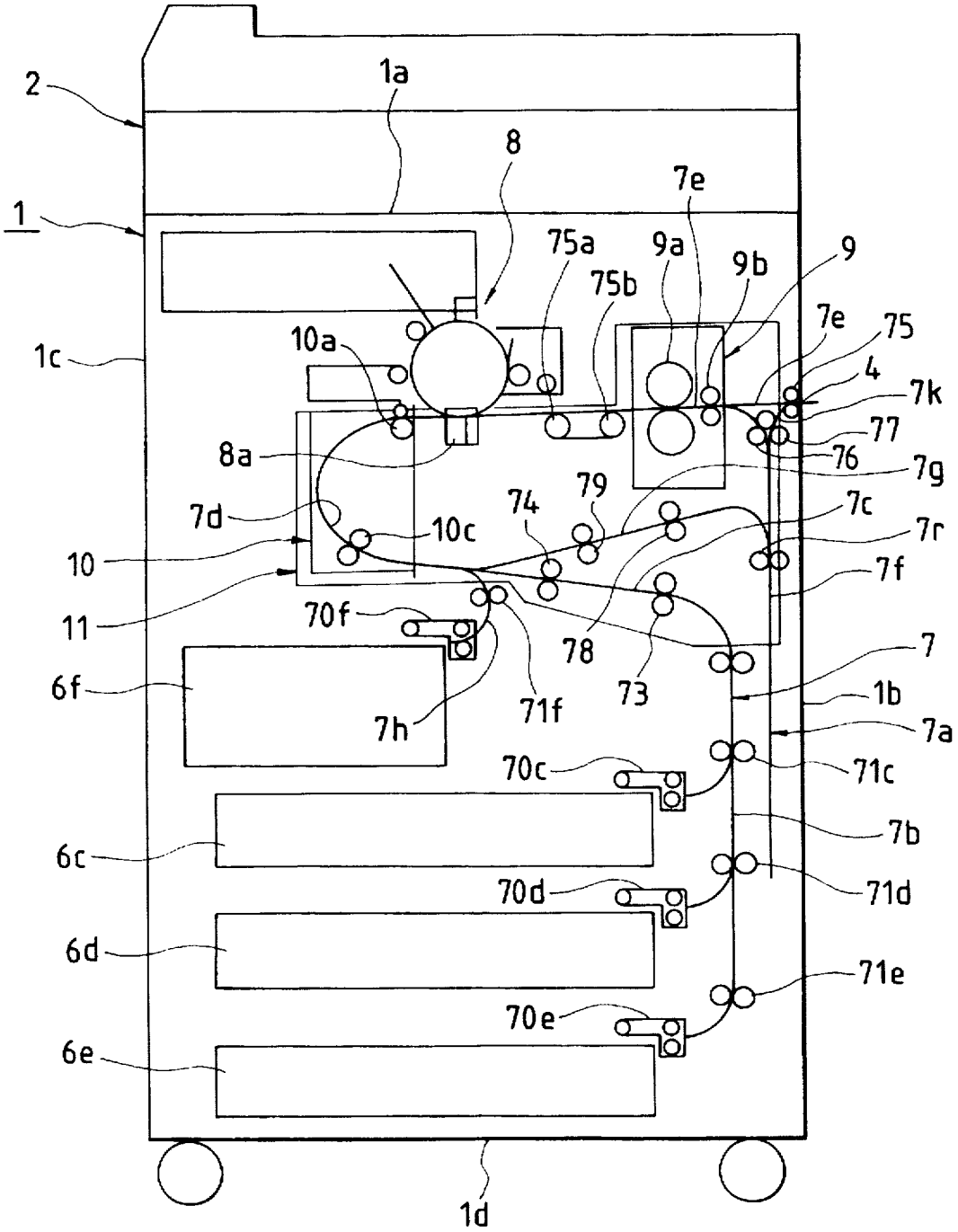
FIG. 3 is an illustration to show the inside of the front of a digital copier of a second embodiment to which the invention is applied.

FIG. 3 shows an example of a digital copier according to a second embodiment to which the invention is applied. Also in the digital copier of the second embodiment, a top face 1a of an apparatus housing 1, a front (not shown), and a right side face 1b are used as operation faces and a left side face 1c and a rear face (not shown) are set to non-operation faces, as in the first embodiment.

In the digital copier of the second embodiment, large-sized storage cassettes 6c–6e of normal paper storage means are placed to the left side face 1c of a non-operation face in the lower portion of the apparatus housing 1 and a small-sized storage cassette 6f as second paper storage means is placed above the large-sized storage cassettes 6c–6e. A before-cassette transport passage 7b for substantially upward transporting paper sent out from the large-sized storage cassettes 6c–6e is placed between the large-sized storage cassettes 6c–6e and a lower portion of the right side face 1b of an operation face. At the cassettes 6c–6e and 6f, the sheets of paper are sent one at a time to the right side face 1b by handling means 70c–70e and 70f each containing a pickup roll disposed above stacked sheets of paper and a pair of double sending prevention rolls, and the sent sheets are guided into transport passages 7b and 7c by paired rolls 71c–71e and 71f.

The cassettes 6c–6e and 6f preferably are trays of the type wherein a sheet storage section is drawn out to the front of the apparatus housing 1. For example, the large-sized tray 6c at the upper stage and the small-sized tray 6f preferably adopt a multitray technique 8 (in a broad sense). That is, different types of sheets are stored in the corresponding placement means and taking-out means sends sheets placed on the selected placement means one at a time in sequence. As the taking-out means moving up and down and left and right to the position of a selected placement bed and feeding paper, means is disclosed in Japanese Patent Laid-Open No. Hei 4-209138. As means for manually moving a selected placement bed to a paper feed roll and feeding paper, means is disclosed in Japanese Patent Laid-Open No. Sho 56-117930. Disclosed in Japanese Patent Laid-Open No. Sho 60-223737 is an apparatus wherein a small-sized placement bed is disposed at the upper stage movably to a sheet feed enable position and a sheet feed disable position and a large-sized placement bed is disposed at the lower stage for feeding sheets on the small-sized placement bed at the paper feed enable position and sheets on the large-sized placement bed at the paper feed disable position. Means for moving a selected placement bed to a paper feed position and feeding paper, already applies as the Japanese Patent Application No. Hei 6-330366.

For example, A3-size, B3-size, and any other size sheets of paper are stored in trays 6c–6e and A4-size sheets of paper most frequently used are stored in the tray 6f, whereby images can be formed on the A4-size sheets of paper most frequently used in a short time, so that images can be formed efficiently on sheets of paper of different sizes. The tray 6f may be a multitray for storing postcards together with A4-size sheets of paper. Even comparatively thick postcards can be sufficiently transported by forming an S-shaped passage of transport passages 7d and 7h described later.

An outlet 4 for discharging already recorded paper to the outside is placed on the right side face 1b in an upper part of the apparatus housing 1. An image formation unit 8, a transfer device 8a (including a separator) disposed facing the image formation unit 8, a fixing device 9 for fixing an unfixed toner image transferred onto a sheet of paper by the transfer device 8 on the sheet of paper, and a resist device 10 for controlling the feed timing of paper fed to the transfer device 8a are placed in the order of the resist device 10, the image formation unit 8, the transfer device 8a, and the fixing device 9 from the left side face 1c. A paper transport passage 7e is placed for diverting paper transported from the large-sized storage cassettes 6c–6e via the before-cassette transport passage 7b or paper sent out from the small-sized storage cassette 6f in a direction substantially opposite to the paper sending direction and again diverting the paper in the resist device 10 in substantially the same direction as the paper sending direction for transporting the paper to a resist position in the resist device 10, then transporting the paper on which an image is recorded through the transfer device 8a and the fixing device 9 to the outlet 4.

In the second embodiment, the paper transport passage 7 for discharging of paper sent out from the large-sized storage cassettes 6c–6e as already recorded paper through the outlet 4 consists of the before-cassette transport passage 7b being positioned before the large-sized storage cassettes 6c–6e for diverting paper sent out in a substantially horizontal direction from the large-sized storage cassettes 6c–6e and transporting the paper sandwiched between paired rolls 71c–71e, the reverse transport passage 7c for diverting the paper passing through the before-cassette transport passage 7b to a direction substantially opposite to the paper sending direction from the large-sized storage cassettes 6c–6e and transporting the paper by pairs of rolls 73 and 74, a rediverting transport passage 7d substantially shaped like a half circumference for again diverting the paper passing through the reverse transport passage 7c in substantially the same direction as the paper sending direction from the large-sized storage cassettes 6c–6e and transporting the paper to the transfer device 8a, and a main transport passage 7e from the transfer device 8a via the fixing device 9 to the outlet 4. The paper sent out in the paper sending direction from the large-sized storage cassettes 6c–6e are diverted twice so as to draw a substantial S letter, then again transported in almost the same direction as the paper sending direction and arrives at the image formation unit 8, which then records a predetermined image on the paper. Then, the paper is transported almost straightly via the fixing device 9 to the outside through the outlet 4 of the apparatus housing 1.

The digital copier of the second embodiment has a double-sided copy function and a face reversing function for forming an image on both front and rear sides of paper and is provided with a reversing transport passage 7a for reversing a sheet of paper having a single side on which an image is already recorded and again feeding the sheet of paper into the image formation unit 8 or discharging to the outlet 4.

The reversing transport passage 7a consists of a transport passage 7f branching from the main transport passage 7e between the fixing device 9 and the outlet 4, extending downward between the before-cassette transport passage 7b and the right side face 1b of the apparatus housing 1, and having pairs of rolls 75 and 7r, a rediverting reversing transport passage 7g branching from above the reversing rollers 7r disposed on the reversing transport passage 7f, merging with the rediverting transport passage 7d, and having pairs of rolls 78 ad 79, and a transport passage 7k branching to the right direction upstream of the reversing transport passage 7f and discharging paper with a face reversed to the outlet 4 by roll 77. The sheet of paper passing through the fixing device 9 and having a single side on which a fixed image is supported is guided into the reversing transport passage 7f from the main transport passage 7e and is transported to the lower end of the reversing transport passage 7f, then is transported substantially upward and guided into the rediverting reversing transport passage 7g, next transported to the rediverting transport passage 7d in a direction substantially opposite to the paper sending direction and is again passed through the image formation unit 8, the transfer device 8a, and the fixing device 9 to the main transport passage 7e, then discharged to the outside through the outlet 4 of the apparatus housing 1.

In the second embodiment, the rediverting reversing transport passage 7g branches above the pair of reversing rollers 7r of the reversing transport passage 7f and is inclined slantingly downward to the termination of the reverse transport passage 7c positioned below the main transport passage 7e for merging with the reverse transport passage 7c. The main transport passage 7e, the rediverting reversing transport passage 7g branching above the pair of reversing rollers 7r of the reversing transport passage 7f branching from the main transport passage 7e, and the reverse transport passage 7c with which the rediverting reversing transport passage 7g merges at the termination thereof are placed substantially like a Z letter, thereby providing a paper transport distance.

Paper sent out from the small-sized storage cassette 6f disposed above the large-sized storage cassettes 6c–6e is passed through the diverting transport passage 7h for diverting the paper transport direction to a direction opposite to the paper sending direction and transferred by an S-shaped passage which merges with the starting end of the rediverting transport passage 7d. Since the transport passage length can be maximized with a small space by forming an S-shaped passage with transport passages 7d and 7h, the distance required for steps from taking out a sheet to transporting the sheet to the resist position can be minimized, and a jam can be made hard to occur because the curve is moderate. Therefore, the apparatus can be miniaturized without degrading the function, image quality, or reliability.

In the digital copier of the second embodiment, as shown in FIGS. 3–6, the transfer device 8*a*, the fixing device 9, the resist device 10, and the portion of the paper transport passage 7 positioned above the large-sized storage cassettes 6*c*–6*e* and the small-sized storage cassette 6*f* are mounted in a drawer frame 12 and are integrally formed as a drawer unit 11, which is attached to the apparatus housing 1 by rail members 13 so that it can be drawn out from the apparatus housing 1.

Figure 4:
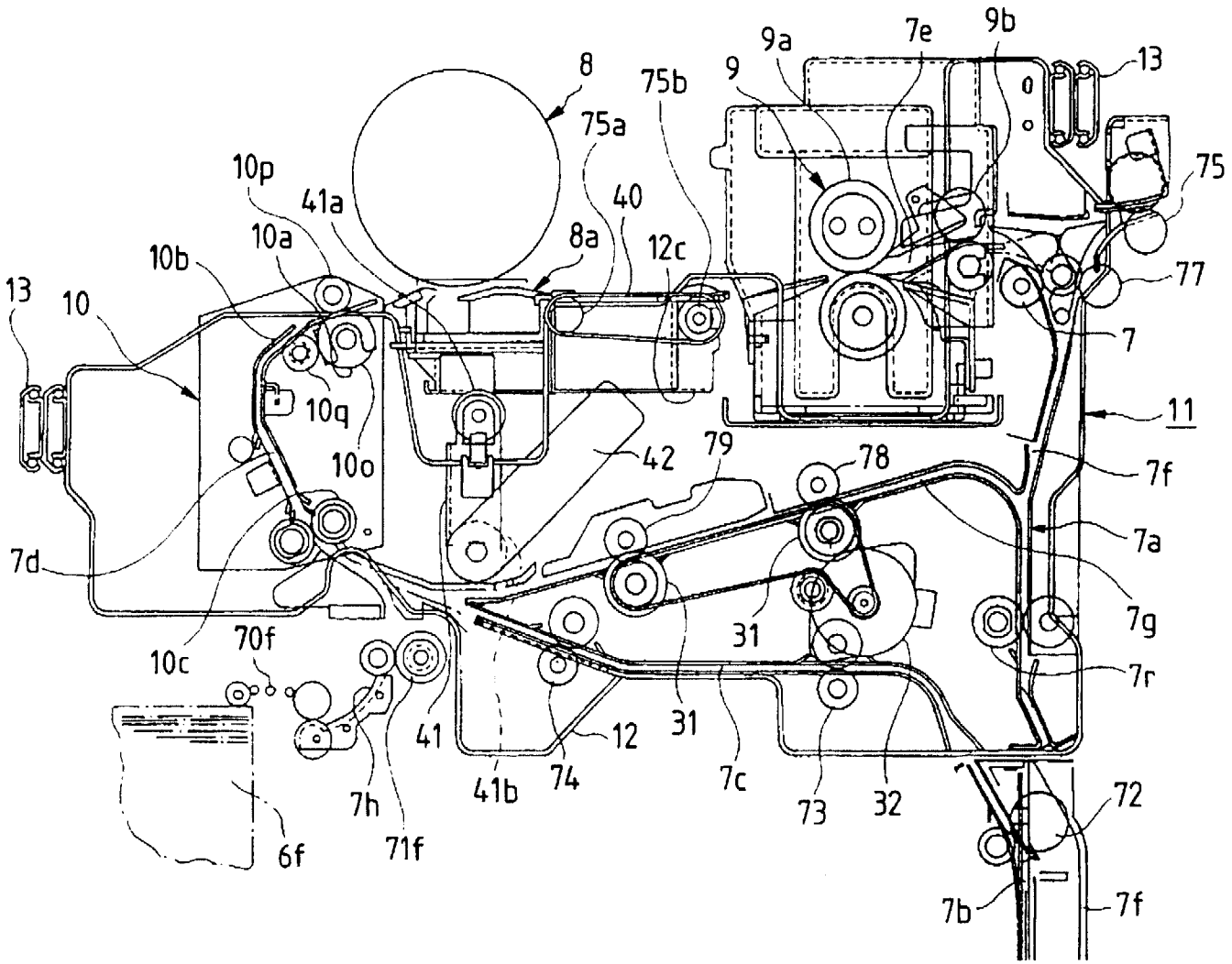
FIG. 4 is an illustration to show a sectional view of a drawer unit disposed in the digital copier in FIG. 3.
Figure 5:
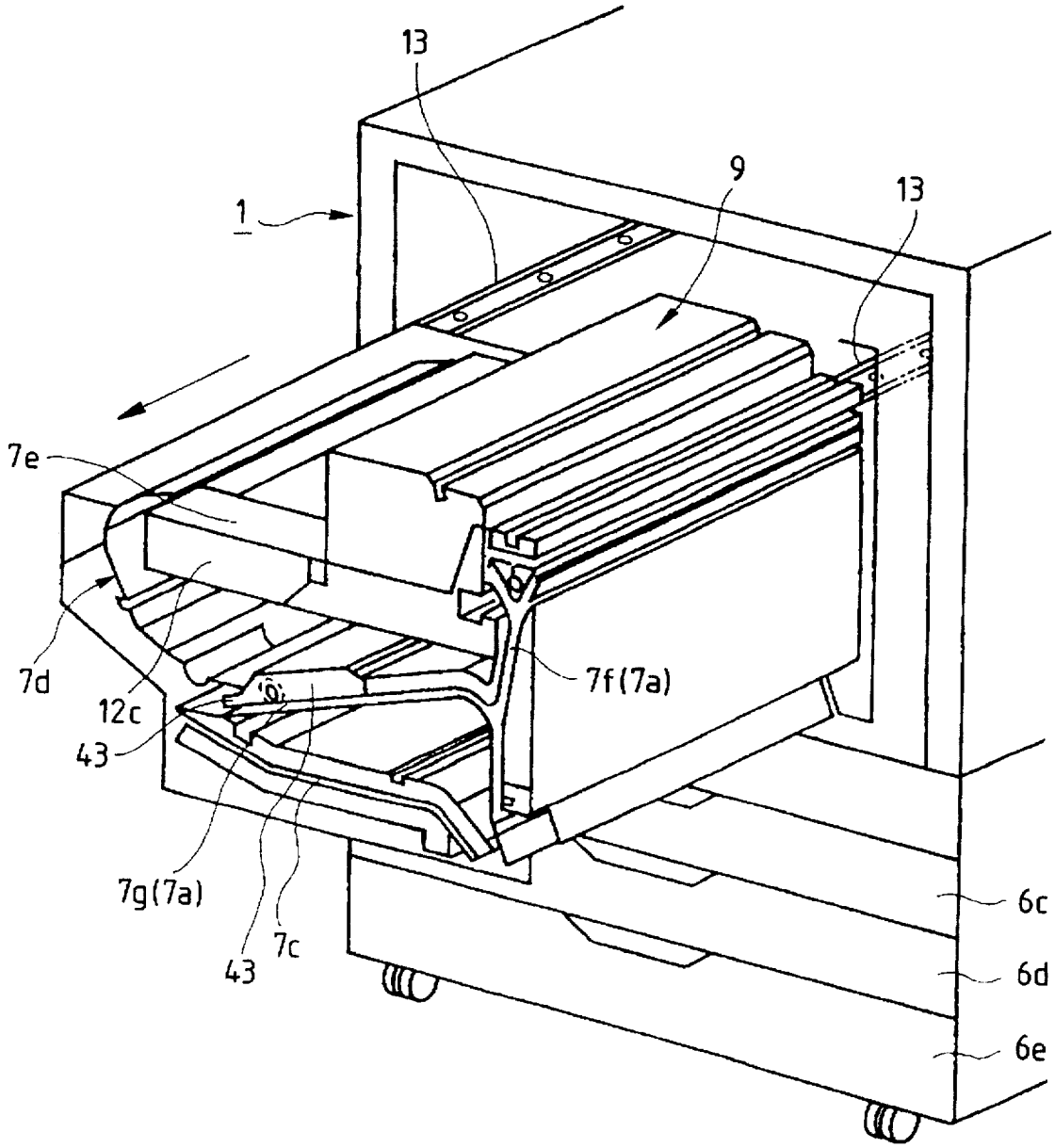
FIG. 5 is an illustration of a perspective view to show a state in which the drawer unit disposed in the digital copier in FIG. 3 is drawn out from the apparatus main unit.
Figure 6:
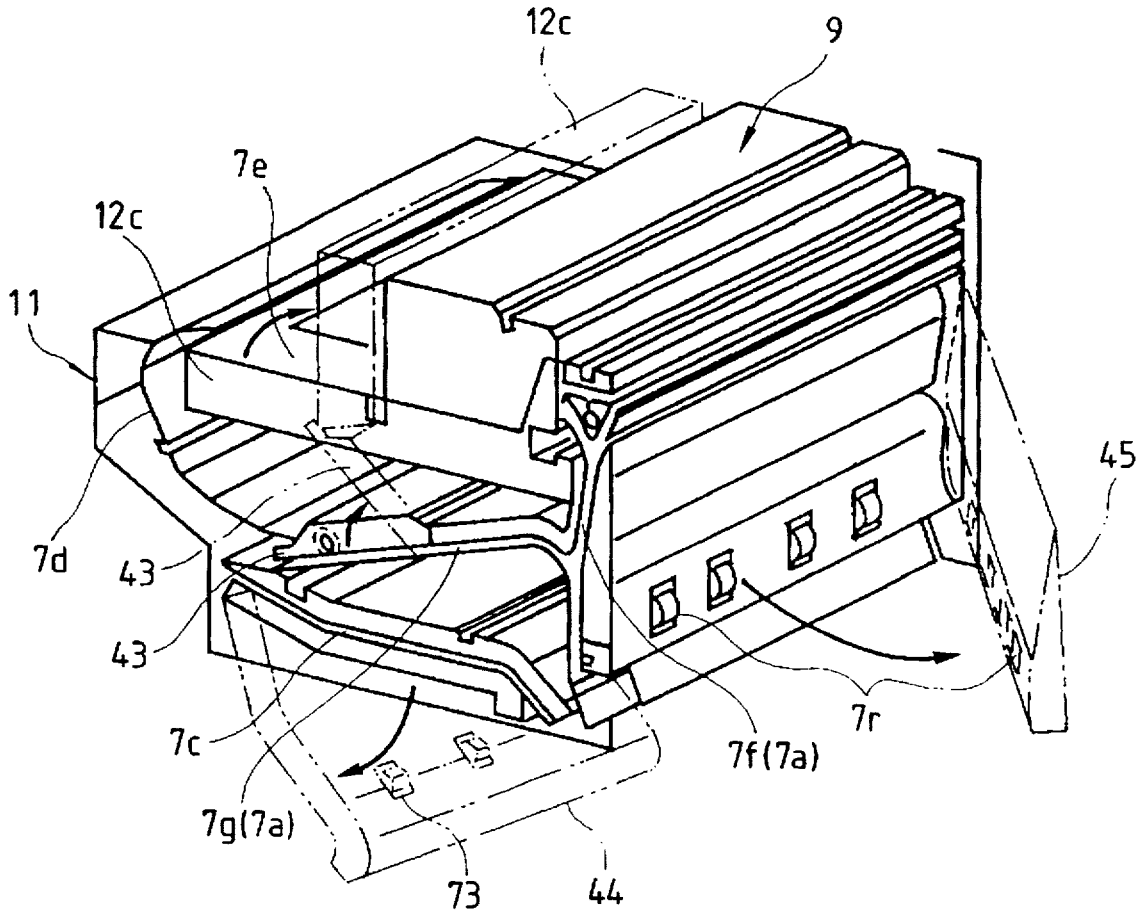
FIG. 6 is an illustration of a perspective view to show an opening/closing section for jam removal.

The portion of the paper transport passage 7 built in the drawer unit 11 includes the reverse transport passage 7*c* being positioned above the large-sized storage cassettes 6*c*–6*e* and the small-sized storage cassette 6*f* for transporting paper from the right side face 1*b* to the left side face 1*c*, the rediverting transport passage 7*d* shaped like a half circumference for again diverting the paper passing through the reverse transport passage 7*c* in substantially the same direction as the paper sending direction from the large-sized storage cassettes 6*c*–6*e* and the small-sized storage cassette 6*f* and transporting the paper to the transfer device 8*a*, the main transport passage 7*e* from the transfer device 8*a* via the fixing device 9 to the outlet 4 for transporting paper in image formation process, the portion of the reversing transport passage 7*a* above the reverse transport passage 7*f*, the transport passage 7*k*, and the rediverting reversing transport passage 7*g*, as shown in detail in FIGS. 4–6.

Figure 7:
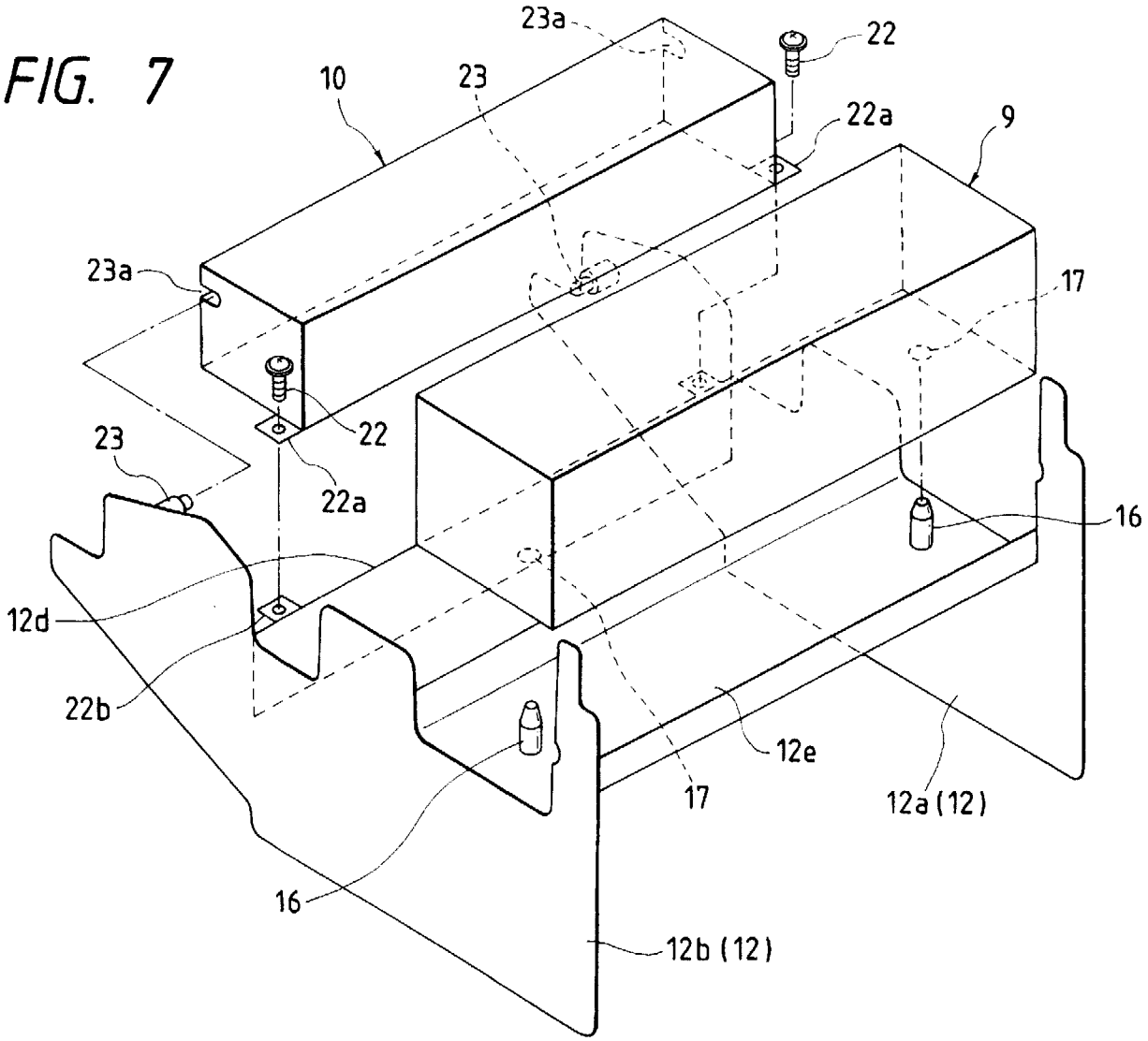
FIG. 7 is an assembly illustration to show a drawer frame of the drawer unit disposed in the digital copier in FIG. 3 and a fixing device and a resist device of a subunit that can be attached to and detached from the drawer frame.
Figure 8:
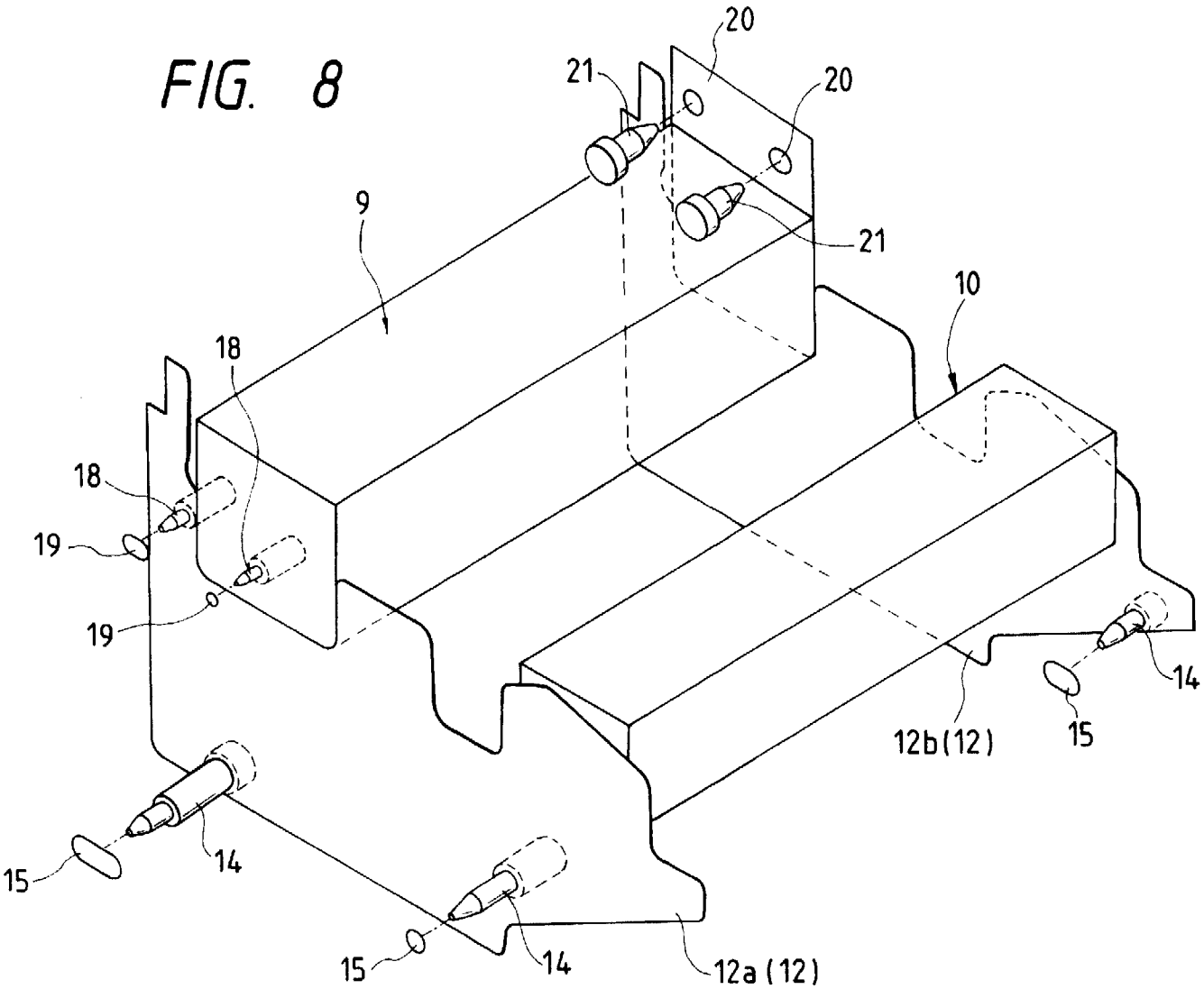
FIG. 8 is an illustration to explain a positioning state of the drawer frame in FIG. 7 and the fixing device and the resist device of the subunit attached to the drawer frame.

In the second embodiment, as shown in FIGS. 7 and 8, the fixing device 9 is formed as a subunit detachable from the drawer frame 12, and the resist device 10 is formed as a subunit detachable from the drawer frame 12 together with the rediverting transport passage 7*d* shaped like a half circumference (not shown).

As shown in FIGS. 7 and 8, positioning between the drawer frame 12 of the drawer unit 11 and the apparatus housing 1 is performed by fitting two positioning pins 14 disposed on a rear frame 12*a* of the drawer frame 12 and one positioning pin 14 disposed on a front frame 12*b* of the drawer frame 12 into two positioning holes 15 made in the rear of the apparatus housing 1 (one is formed as a long hole and the other as a round hole) and one positioning hole 15 made in the front (in the second embodiment, a long hole).

As shown in FIGS. 7 and 8, the fixing device 9 is positioned by fitting two positioning holes 17 made in the bottom of the fixing device 9 into two positioning pins 16 spaced from each other and disposed upward on a placement face of a plate 12*e* for connecting the rear face 12*a* and the front frame 12*b* of the drawer frame 12 and serving as a support bed of the fixing device 9, by fitting two positioning pins 18 disposed on the rear of the fixing device 9 into two positioning holes 19 made in the rear of the apparatus housing 1 (one is formed as a long hole and the other as a round hole), and by fitting two positioning holes 20 made in the front of the fixing device 9 (one is formed as a long hole and the other as a round hole) and two positionings pins 21 in the front of the apparatus housing 1, whereby the fixing device 9 is positioned accurately for the image formation unit 8 positioned for the apparatus housing 1.

Further, as shown in FIG. 7, the subunit of the resist device 10 has two attachment plates on the front and the rear of the right bottom and the drawer frame 12 contains a support plate 12*d* connecting rear plates 12*a* and 12*b* and having two attachment plates 22*a* of the subunit. The subunit of the resist device 10 is fixed to the drawer frame 12 by the attachment plates 22*a* and 22*b* with two 22 screws and is locked adjustably to lock pins 23 disposed on the rear frame 12*a* and the front frame 12*b* of the drawer frame 12 by two notches 23*a* made in the front and rear of the upper-left parts of the subunit, whereby the fixing position of the resist device 10 can be finely adjusted.

Figure 9:
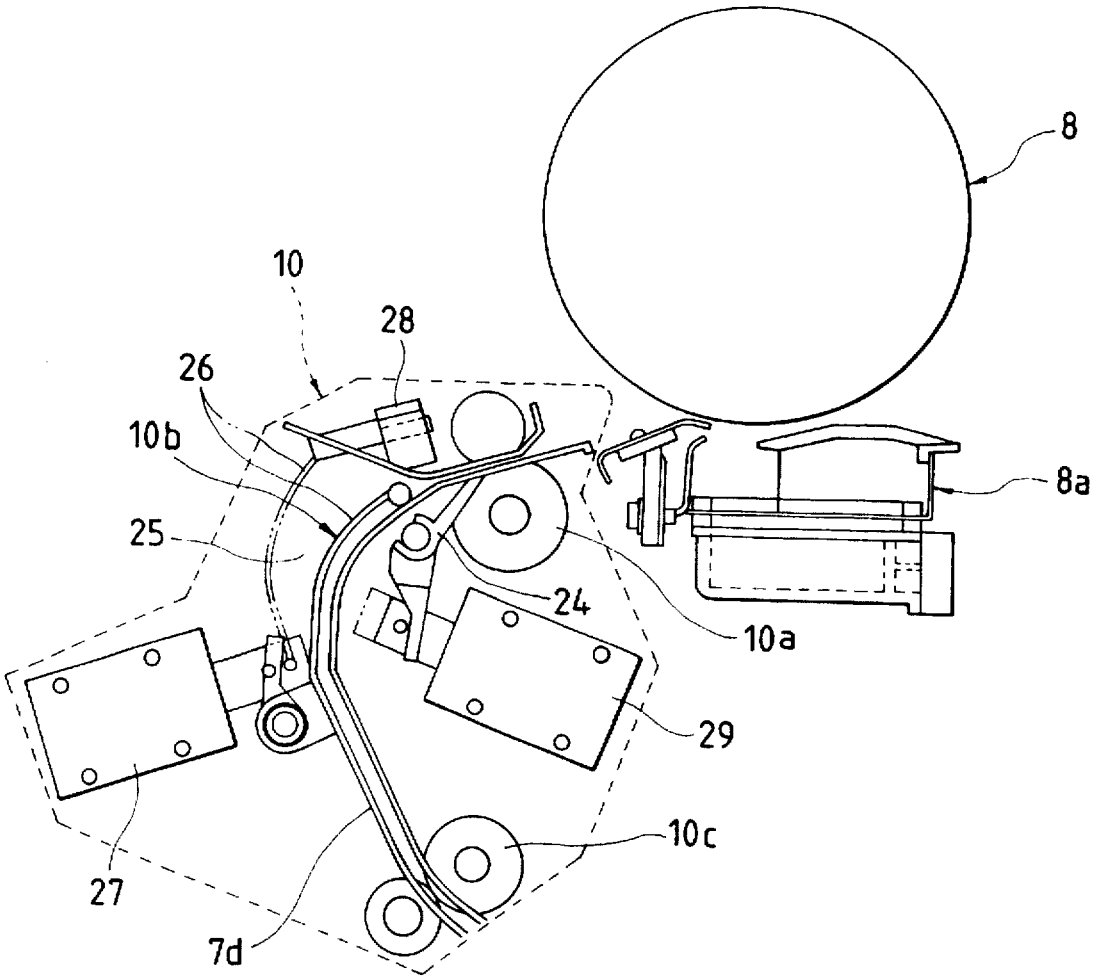
FIG. 9 is an illustration to specifically explain the function of the resist device of the drawer unit disposed in the digital copier in FIG. 3.

In the second embodiment, as shown in FIG. 9, the resist device 10 is made up of a resist roll 10*a* disposed just before the transfer device 8*a* downstream of the rediverting transport passage 7*d* curving substantially like a half circumference, baffle means 10*b* disposed downstream of the rediverting transport passage 7*d* and taking a first position A for transporting the tip of paper to a gate 24 of a resist position of the paper (the position where a baffle plate 26 is indicated by the solid line in FIG. 9) and a second position B for forming a resist loop for the paper (the position where the baffle plate 26 is indicated by the broken line in FIG. 9), and a preresist roller 10*c* disposed upstream of the rediverting transport passage 7*d* for feeding paper into a loop formation area 25 of the rediverting transport passage 7*d* at a predetermined timing. The baffle means 10*b* is made up of the baffle plate 26, a solenoid 27, and a resist sensor 28. When the resist sensor 28 senses passage of the tip of paper, the solenoid 27 moves the baffle plate 26 to the second position B; when the resist sensor 28 senses passage of the rear end of papers the solenoid 27 moves the baffle plate 26 to the first position A. The gate 24 is opened or closed by a solenoid 29 operating in synchronization with the operation of the image formation unit 8.

Figure 10:
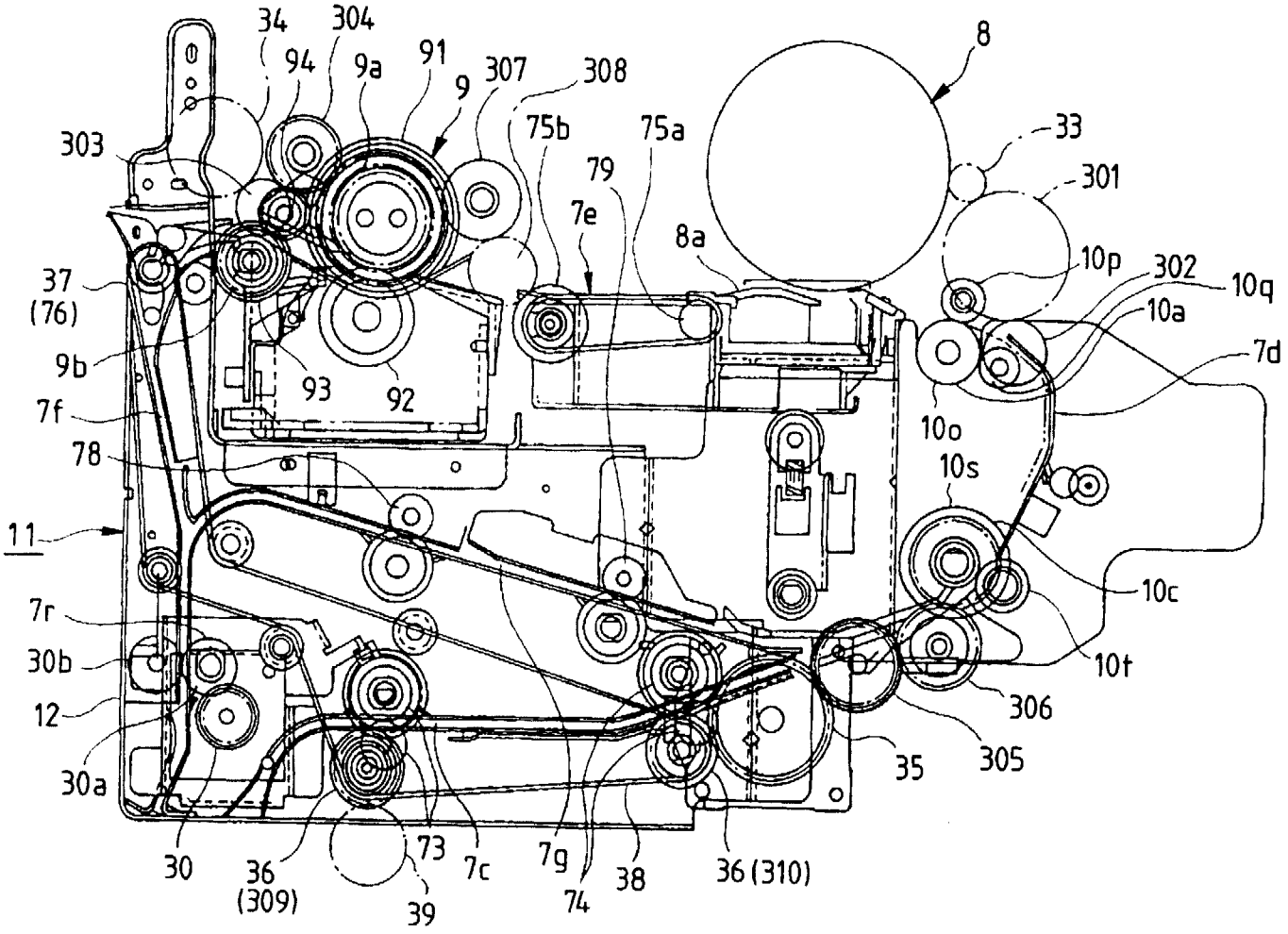
FIG. 10 is an illustration to explain a drive apparatus in the drawer unit disposed in the digital copier in FIG. 3.

Further, in the second embodiment, as shown in FIGS. 4 and 10, the drawer unit 11 incorporates a reversing motor 30 for driving the reversing rollers 7*r* of consisting of a pair of rolls 30*a* and 30*b* and a drive motor 32 for driving transport rollers 31 consisting of two pairs of rolls 78 and 79 for transporting paper having a single side on which recording is already performed in the rediverting transport passage 7*g*. The reversing motor 30 drives the roll 30*a* for rotating the roll 30*b*, thereby feeding paper having a single side on which recording is already performed downward of the reversing transport passage, and reversely turns for reversing the paper having a single side on which recording is already performed and feeds the paper into the rediverting reversing transport passage 7*g*. The lower roll of the pair of rolls 78, 79 is driven via a belt by the motor 32 for rotating the upper roll, whereby the paper having a single side on which recording is already performed, fed into the rediverting reversing transport passage 7*g* is transported by the transport roller 31.

As shown in FIG. 10, the resist roller 10*a* consisting of a pair of rolls 10*o* and 10*p* incorporated in the drawer unit 11 is drive as follows: The roll 10*o* having on a shaft a gear engaging via gears 301 and 302 disposed in the apparatus housing 1 when the drawer unit 11 is mounted receives rotation power from a drive motor 33 mounted in the apparatus housing 1 for driving a photosensitive body and others of the image formation unit 8 and rotates the roll 10*p* and a nearby roll 10*q*. A fixing roller 9*a* of the fixing device 9 consists of a heating roller 91 and a pressurizing roller 92. The heating roller 91 having on a shaft a gear engaging via a gear 303 disposed in the apparatus housing 1 and a gear 304 disposed in the drawer unit 11 and engaging the gear 303 when the drawer unit 11 is mounted receives rotation power from another drive motor 34 mounted in the apparatus housing 1 for driving the pressurizing roller 92. Likewise, a lower roll 93 of a pair of rolls 9*b* disposed downstream of the fixing roll 9*a* in the fixing device 9 is driven with a gear on a shaft engaging the gear 303 in the apparatus housing 1, whereby an upper roll 94 rotates. The transport passage 7*e* for transporting a sheet onto which an image is transferred by the transfer device 8*a*, separated from a photosensitive body by a separator to the fixing device 9 has rolls 75*a* and 75*b* rotated with a belt having a hole sucking downward. The roll 75*b* having on a shaft a gear engaging a gear 308 disposed in the unit 11 and engaging the gear on the shaft of the heating roller 91 is driven via the gears 307, 308 and the roll 75*a* is driven via the belt for sucking a sheet and transporting it to the fixing device 9. For the preresist roller 10*c*, a roll 10*s* having on a shaft a gear engaging via gears 305 and 306 disposed in the apparatus housing 1 is driven from a drive motor 35 mounted in the apparatus housing 1 for the preresist roller 10*c* and rotates roll 10*f*. Pulley 36 (309, 310) corresponding to transport roller 73, 74 for transporting paper in the reverse transport passage 7*c* and transport rollers 37 (76) of a pair of rolls for feeding paper having a single side on which recording is already performed into the transport passage 7*f*, on which a timing belt 38 is placed, are driven via a gear 39 from the drive motor 34 in the apparatus housing 1.

Resultantly, the upper rolls with shafts which are gears engaged with the pulleys 309, 310 are rotated, thereby the lower rolls are rotated.

In the second embodiment, as shown in FIG. 4, a moving frame 12*c* that can pivot on the fixing device 9 is attached to the portion of the drawer frame 12 of the drawer unit 11 corresponding to the reversing transport passage 7*e* from the transfer device 8*a* to just before the fixing device 9. The transfer device 8*a* and a conveyor belt 40 forming the reversing transport passage 7*e* from the transfer device 8*a* to just before the fixing device 9 are mounted in the moving frame 12*c*. When the drawer unit 11 is drawn out from the apparatus housing 1, the transfer device 8*a* can be set apart from the image formation unit 8 of the apparatus housing 1.

Figure 11:
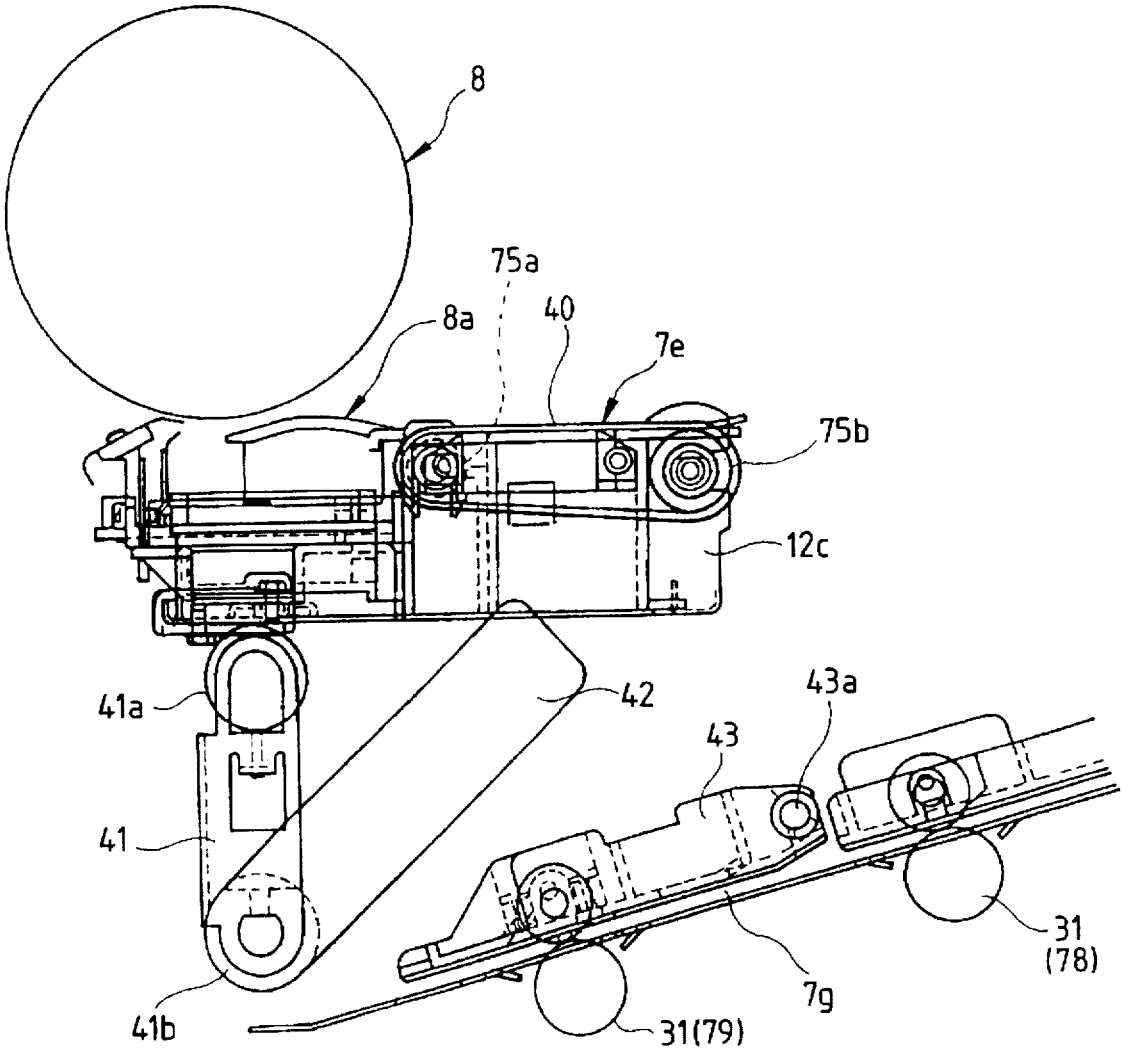
FIG. 11 is an illustration to explain a normal support state of a moving frame disposed in the drawer frame of the drawer unit disposed in the digital copier in FIG. 3.
Figure 12:
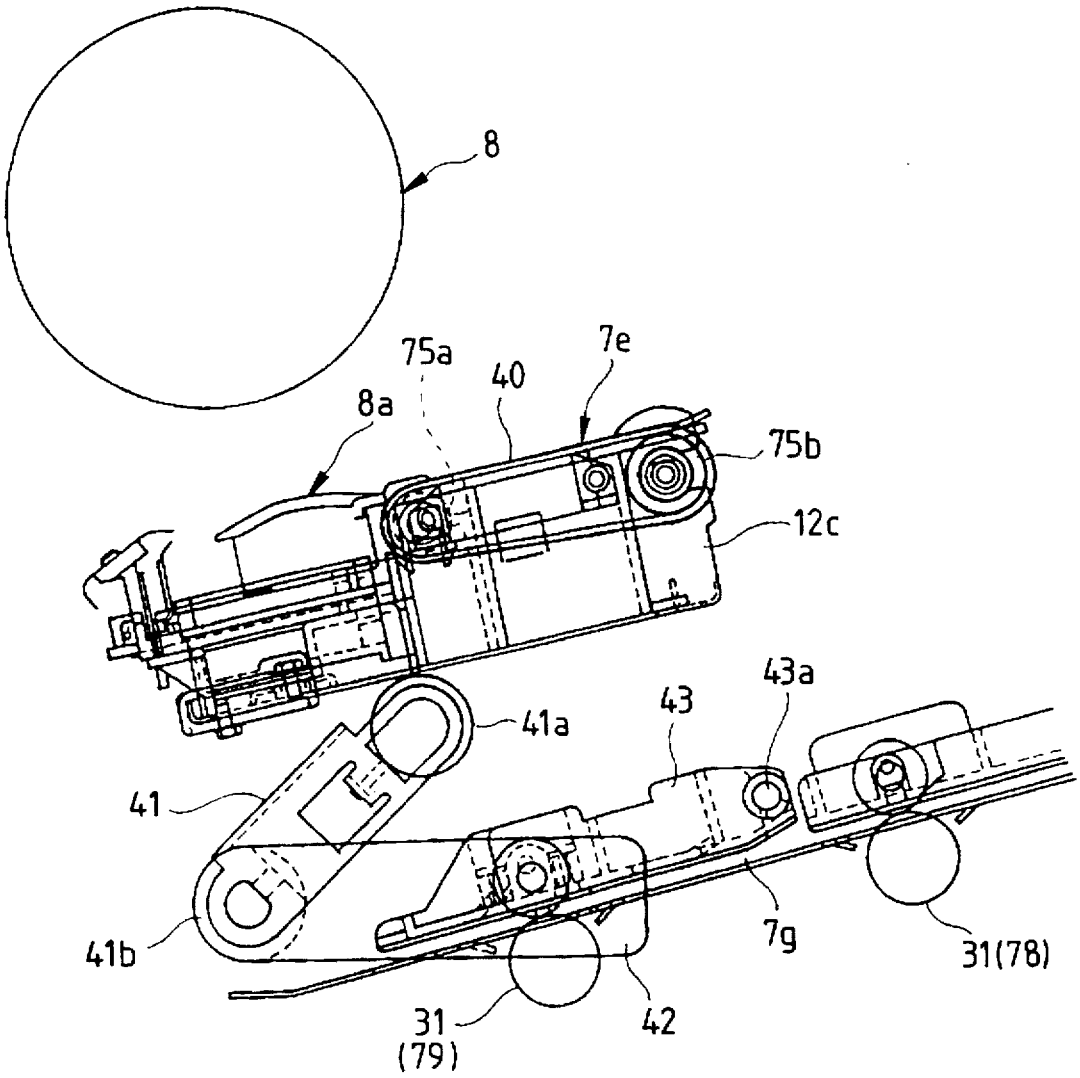
FIG. 12 is an illustration to show a state in which the moving frame in FIG. 11 is fallen for enabling the drawer unit to be drawn out from the apparatus main unit.

As shown in detail in FIGS. 4, 11, and 12, the moving frame 12*c* in which the transfer device 8*a* and the conveyor belt 40 are mounted is supported to a predetermined position with a support rod 41 having a roller 41*a* on a free end and a base end pivotably supported with a pivot 41*b*. The pivot 41*b* of the support rod 41 is extended to the front of the front frame 12*b* of the drawer frame 12 and a handle 42 is attached thereto for handling the support rod 41 to release the support state of the moving frame 12*c* for setting the transfer device 8*a* apart from the image formation unit 8 and drawing out the drawer unit 11.

Figure 13:
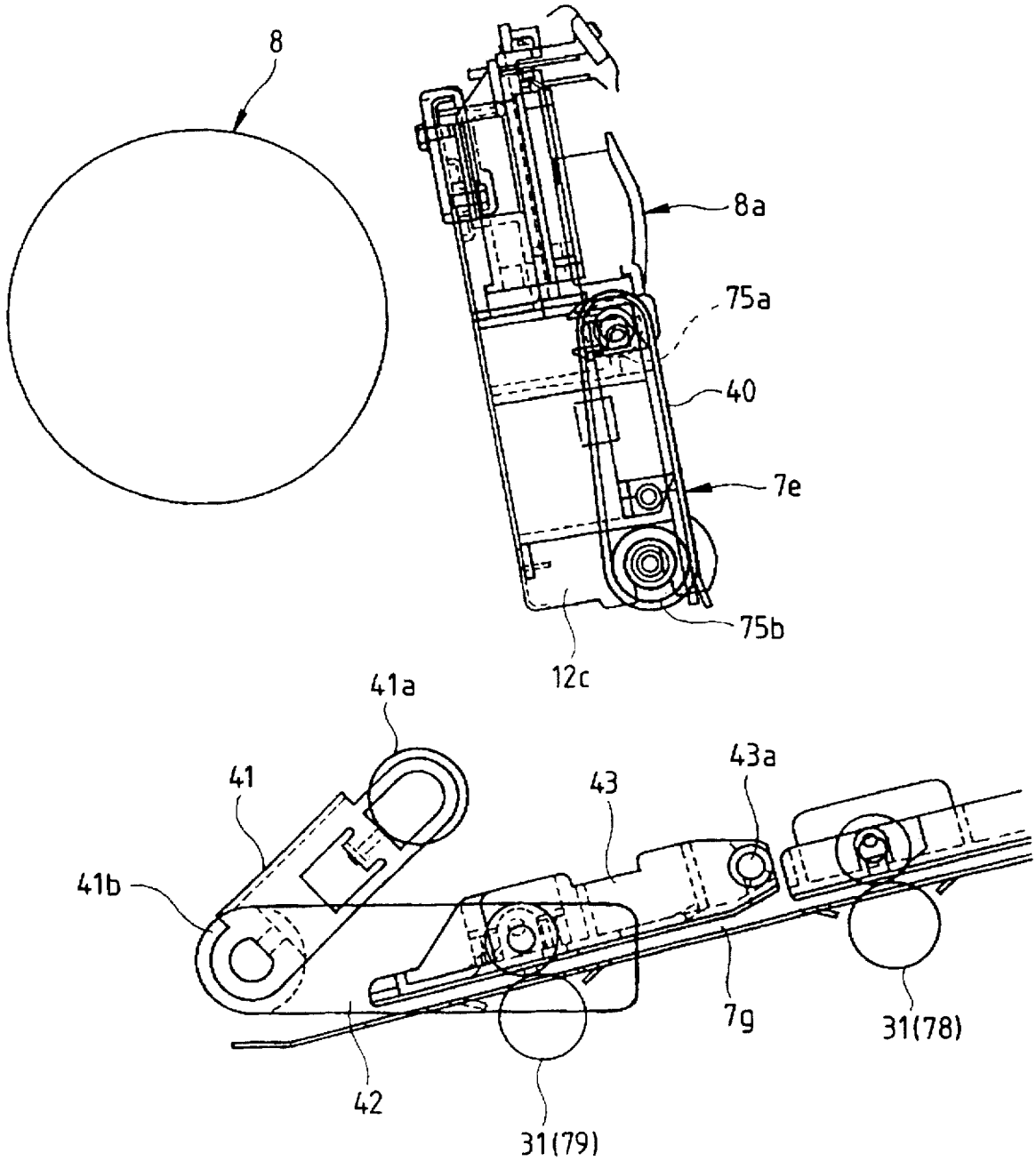
FIG. 13 is an illustration to show a state in which after the drawer unit in FIG. 11 is drawn out from the apparatus main unit, the moving frame is opened upward.
Figure 14:
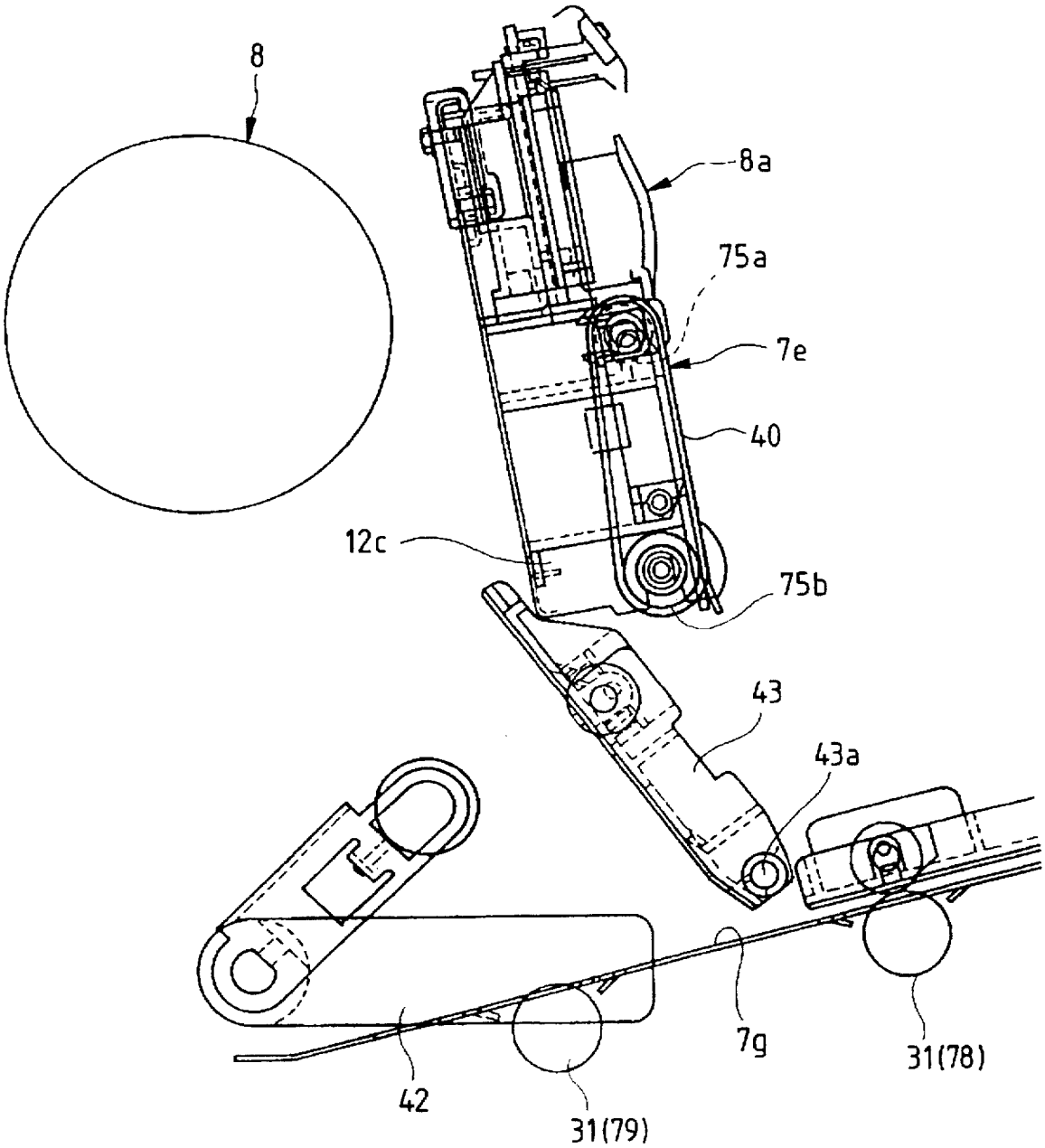
FIG. 14 is an illustration to show a state in which after the drawer unit in FIG. 11 is drawn out from the apparatus main unit, the moving frame is opened upward and then a rediverting reversing transport passage of paper having a single side on which recording is already performed is opened for jam handling.

For jam removal when jam trouble occurs in the rediverting reversing transfer passage 7*g*, an opening/closing section 43 having one end pivotally supported with a shaft 43*a* is disposed on the top face of the rediverting reversing transfer passage 7*g* and as shown in FIG. 12, the support state of the moving frame 12*c* with the support rod 41 is released and the drawer unit 11 is drawn out, then as shown in FIG. 13, the free end of the moving frame 12*c* is lifted up and as shown in FIG. 14, an free end of the opening/closing section 43 is lifted up for opening.

Further, for removal of jam trouble occurring in the upper portion of the reverse transport passage 7*c* and the reversing transport passage 7*f* built in the drawer unit 11, opening/closing sections 44 and 45 disposed in the reverse transport passage 7*c* and the reversing transport passage 7*f* are opened, as shown by broken lines in FIG. 6. At this time, of rolls in the opening/closing sections 44 and 45 of 7*f* and a pair of rollers 73 and 74, upper and inner rolls are fixed to the unit and lower and outer rolls are disposed in opening/closing sections 44 and 45. Resultantly, jam removal is facilitated.

Figure 15:
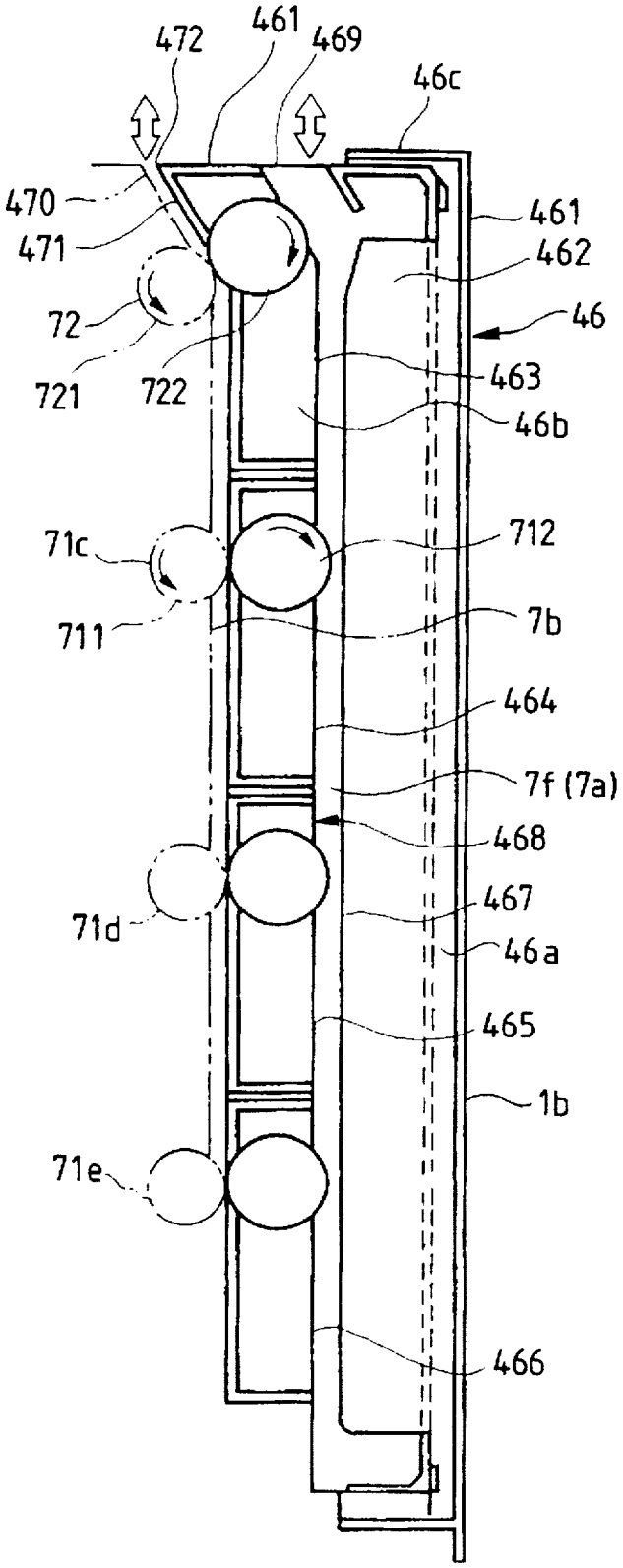
FIG. 15 is a sectional illustration to show an opening/closing section for jam removal disposed in the lower part of the right side face of the digital copier in FIG. 3 (operation face)
Figure 16:
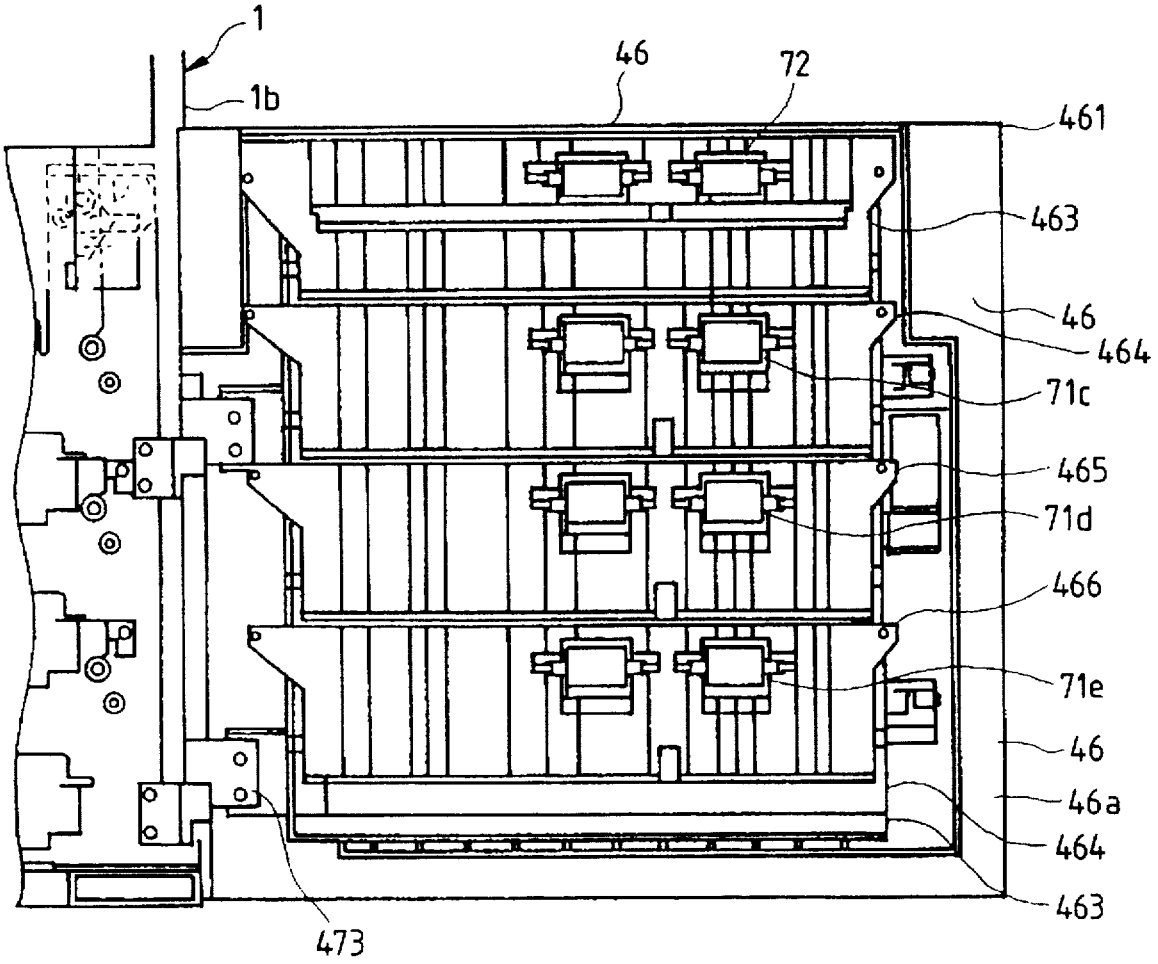
FIG. 16 is an open state from a first opening/closing section for jam removal in FIG. 15.

Further, in the second embodiment, as shown in FIGS. 15 and 16, an opening/closing section 46 for jam removal is disposed in the lower part of the right side face 1*b* of an operation face of the apparatus housing 1. It is formed as a double door structure consisting of a second opening/closing section 46*b* for solving jam trouble occurring in the before-cassette transport passage 7*b* and a first opening/closing section 46*a* for solving jam trouble occurring in the lower part of the reversing transfer passage 7*f* extended between the before-cassette transport passage 7*b* and the right side face 1*b*. That is, the opening/closing section 46 preferably is structured as follows: First, the first opening/closing section 46*a* contains a cover 461 forming the lower part of the outer wall face of the right side face 1*b* of the housing 1 and covering the second opening/closing section 46*b* and a rib 462 rising from the cover 461 of a length of about a lower half of the transport passage 7*f* to the inside so as to provide a lower passage of a sheet when the rear end of the sheet (namely, the tip after reversion) is temporarily sandwiched between a pair of rolls 7*r* and the sheet is dangled when the face or the image formation face is reversed, and forming one wall of the passage. The second opening/closing section 46*b* has a frame 46*c* having an open part to allow the rib 462 to enter when the first opening/closing section 46*a* is closed and four subassembly sections 463 to 466 attached to the frame 46*c* on the front and rear sides and each having outer rolls 72 and 712 of pairs of rolls 72, 71*c*, 71*d*, and 71*e*. The outer rolls 722 and 712 rotating clockwise appear on the two transport passages 7*b* and 7*f* and preferably have at least outer peripheral surfaces made of synthetic resin so that when the tip of a sheet is dropped from an entrance 469 of the reversing transport passage 7*f* made up of an outer wall 468 of the subassembly sections 463–466 and an end face 467 of the rib 462, the sheet is softly taken in and that when the sheet is pulled up, no resistance occurs. On the other hand, inner rolls 721 and 711 of pairs of rolls 72, 71*c*, 71*d*, and 71*e* jumping out to the transport passage 7*b* made up of an inner wall 470 the housing 1 and an inner wall 471 of the subassembly sections 463–466 are disposed in the corresponding positions of the housing 1. A sheet is sandwiched between the inner roll 721, 711 and the outer roll 722, 712 and the inner rolls 721 and 711 rotate counterclockwise so as to send the sheet to the transport passage 7*c*, thereby transporting upward the sheet to an exit 472 of the passage. Preferably the inner rolls 721 and 711 have outer peripheral surfaces made of elastic substances such as rubber.

The opening/closing section 46 as the double door is attached to the apparatus housing 1 pivotably with a hinge 473, etc., on the rear face of the right side face 1*b* of the housing 1, namely, the depth. Preferably, the first opening/closing section 46*a* and the second opening/closing section 46*b* are normally locked and when the first opening/closing section 46*a* is opened to the outside, the second opening/closing section 46*b* is also opened accordingly. When they are unlocked, the first opening/closing section 46*a* and the second opening/closing section 46*b* are separated and opened.

Embodiment 3

Figure 17:
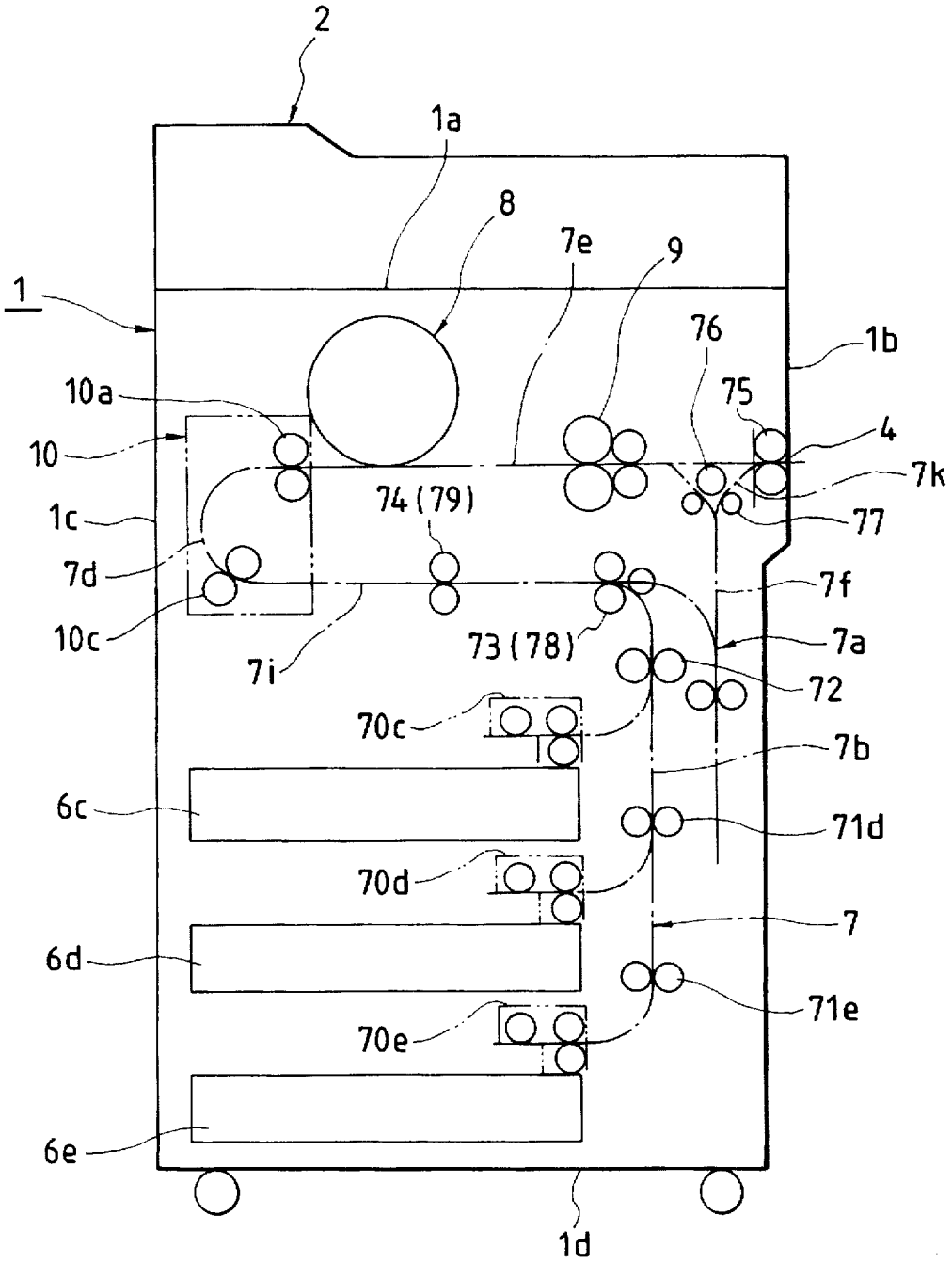
FIG. 17 is an illustration to show the inside of the front of a digital copier of a third embodiment to which the invention is applied.
Figure 18:
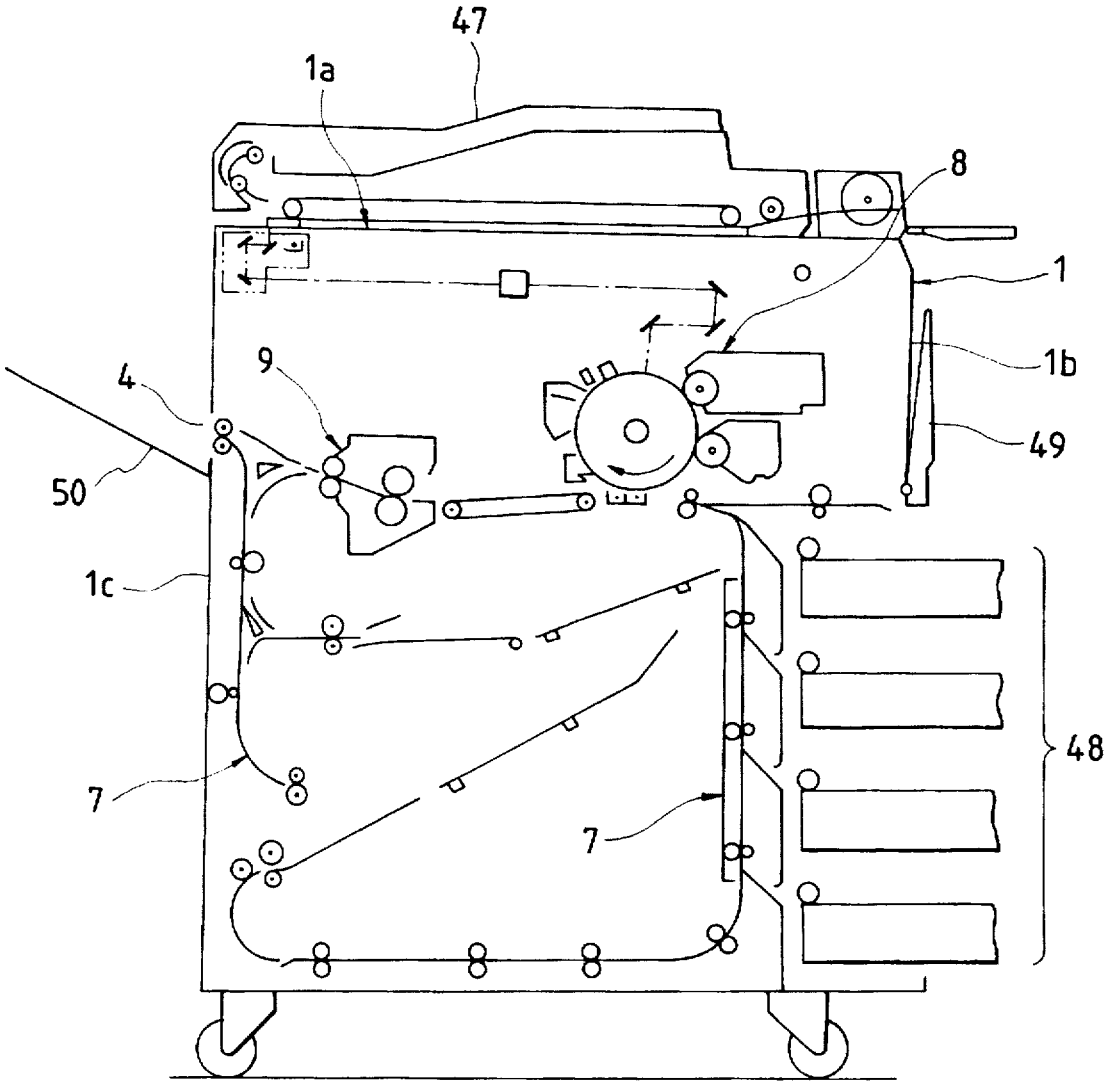
FIG. 18 is an illustration to show the inside of the front of a conventional electrophotographic copier.
Figure 19:
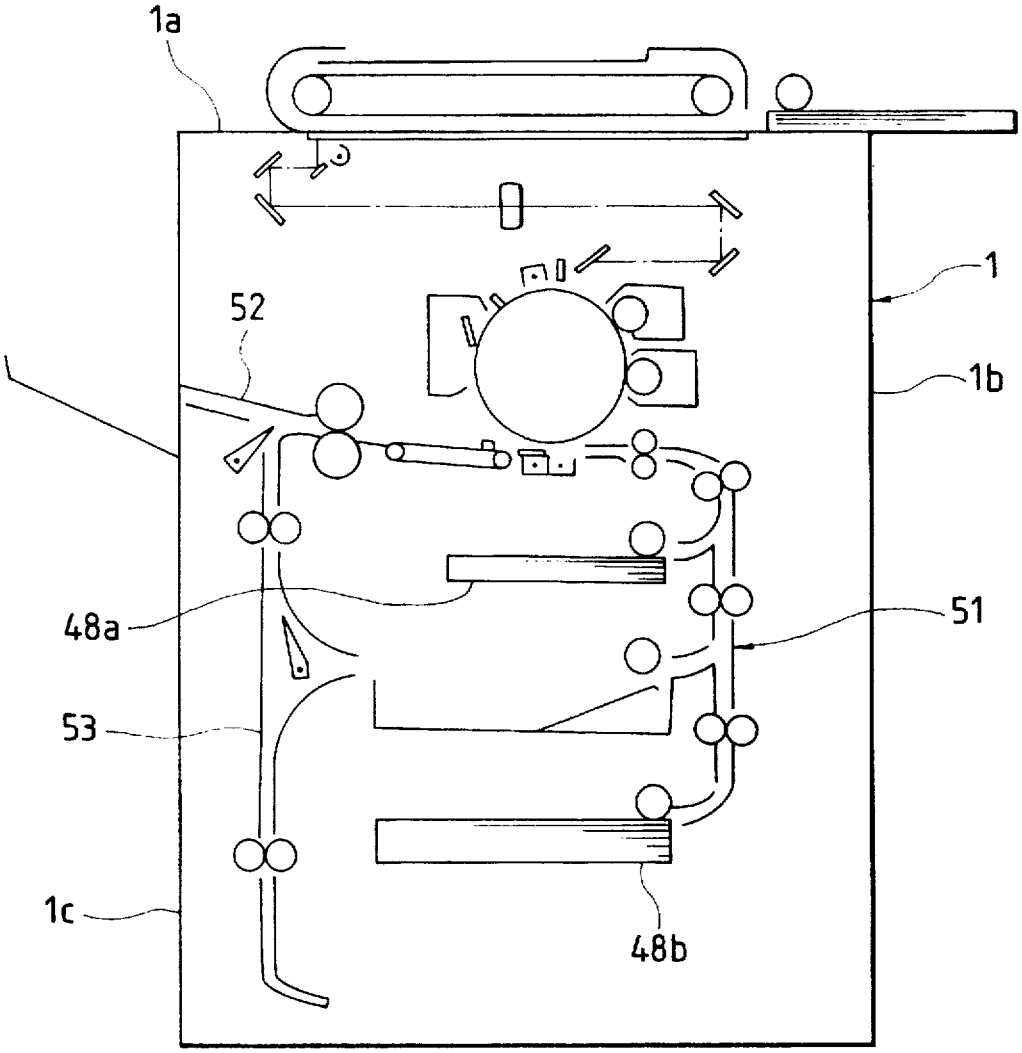
FIG. 19 is an illustration to show the inside of the front of another conventional electrophotographic copier.
Figure 20:
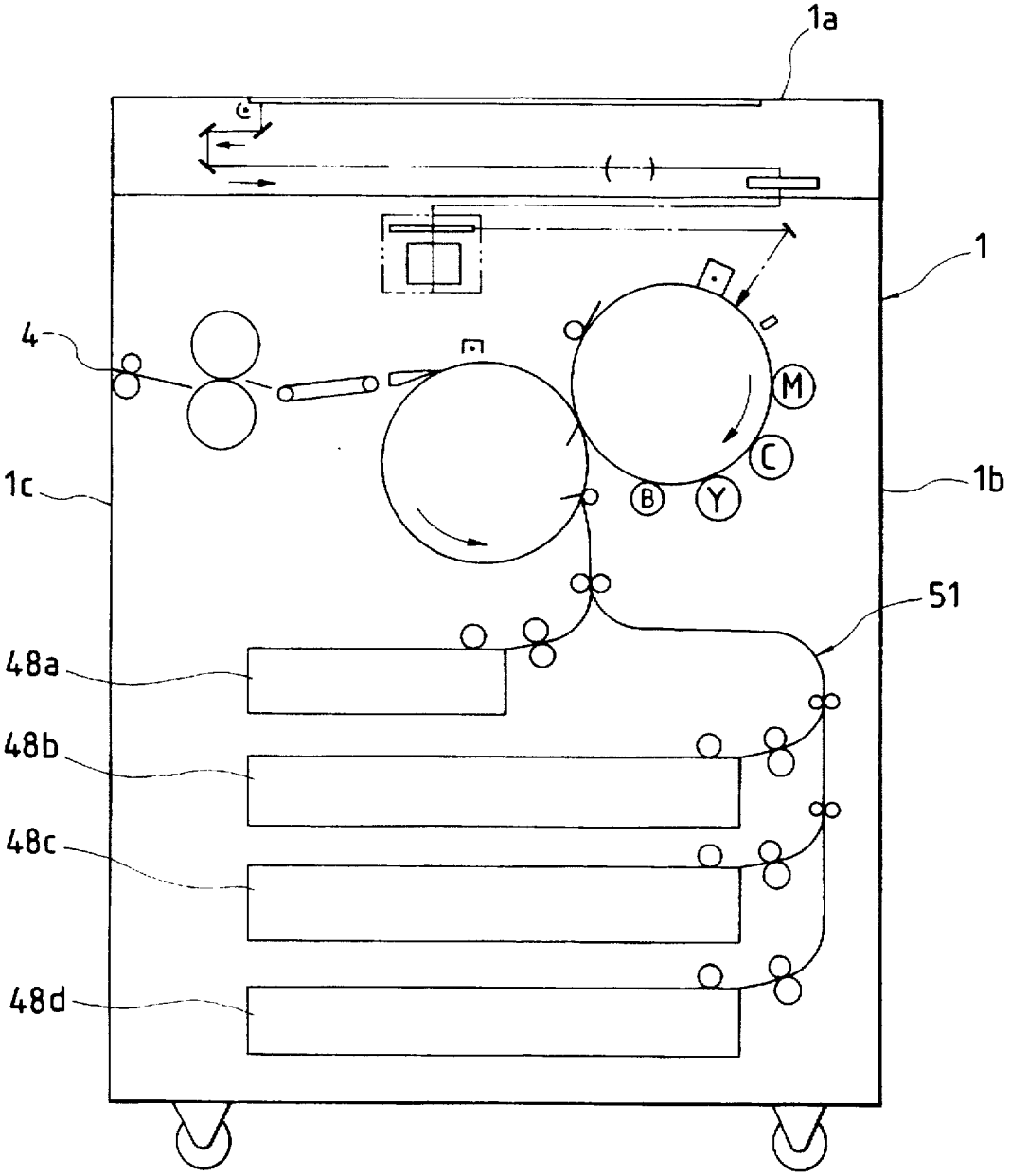
FIG. 20 is an illustration to show the inside of the front of another conventional electrophotographic copier.

FIG. 17 shows the configuration of an example of a digital copier according to a third embodiment to which the invention is applied.

Also in the digital copier of the third embodiment, a top face 1*a* of an apparatus housing 1, a front (not shown), and a right side face 1*b* are used as operation faces and a left side face 1*c* and a rear face (not shown) are set to non-operation faces, as in the first and second embodiments.

In the digital copier of the third embodiment, unlike the first and second embodiments, a dual-purpose transport passage 7*i* is provided which serves as both a reverse transport passage 7*c* from a before-cassette transport passage 7*b* of a paper transport passage 7 to a rediverting transport passage 7*d* shaped like a circumference in which a resist device 10 is built in and a rediverting reversing transport passage 7*g* from a reversing transport passage 7*f* of a reversing transport passage 7*a* to the rediverting transport passage 7*d* in a double-sided copy, whereby the height of the apparatus is lowered. That is, pairs of rolls 73 and 74 of transport passage 7*c* can also be used for pairs of rolls 78 and 79 of transport passage 7*g*; the corresponding parts of the first and second embodiments can be simplified and the apparatus can be miniaturized.

In the digital copier of the third embodiment, a sheet of paper sent out from large-sized storage cassettes 6*c*–6*e* is transported from the before-cassette transport passage 7*b* via the dual-purpose transport passage 7*i* to the rediverting transport passage 7*d* shaped like a circumference where the sheet is sent out to a transport passage 7*e* at a predetermined timing by the resist device 10 and an image is formed. In a single-sided copy mode, the sheet is discharged intact through an outlet 4 to the outside of the apparatus. In a double-sided copy mode, the sheet is fed into the reversing transport passage 7*f* of the reversing transport passage 7*a* where the sheet is reversed and is again transported through the dual-purpose transport passage 7*i* to the rediverting transport passage 7*d* shaped like a circumference for a double-sided copy.

As we have discussed, the image formation apparatus produces the following effects:

According to the first aspect of the invention, all operation portions for performing operation for the image formation apparatus from the outside of the apparatus are put together on three operation faces consisting of the top face, the front, and either the left or right side face of the apparatus, and the rear face and the other side face of the apparatus are set to non-operation faces. Thus, the image formation apparatus can be installed with the rear face and either the left or right side face of the apparatus set to non-operation faces placed adjoining walls at corners of a room. The operator can concentrate on operation for the image formation apparatus from the top face, the front, and either the left or right side face of the apparatus used as operation faces. Flexibility of the installation place of the apparatus is improved and the installation space of the apparatus can also be used more efficiently. Moreover, the image formation apparatus is also excellent in operability.

According to the second aspect of the invention, the sheet taking-out direction and discharging direction are matched on one side face of the apparatus main unit used as an operation face, the passage from taking out a sheet to discharging of the sheet is formed almost like an S letter, and the opening/closing section for jam removal is disposed on the front and the one side face, whereby when jam trouble occurs, jam removal can be executed easily and promptly from the operation face and the front without moving the entire apparatus and the distance required for transporting a sheet can be shortened; the width of the apparatus main unit can be shortened, accomplishing miniaturization of the apparatus. Moreover, the main transport means required for image formation is disposed so as to transport sheets from the other side face of the apparatus main unit to the outlet made in the one side face, namely, sheets are transported almost horizontally, thus high-quality images can be formed with high reliability.

According to the third aspect of the invention, the transport channel from taking out a sheet to discharging of the sheet is formed almost like an S letter as in the second aspect of the invention; however, since the sheet is diverted from the first transport means to the main transport means by the resist means, the apparatus device can be furthermore shortened as compared with the second aspect of the invention.

According to the fourth aspect of the invention, the components are put into a unit, whereby all jams occurring in the transport channel consisting of the first transport means, the resist means, and the main transport means for which operation such as jam removal from the front is required can be removed from the outside of the unit and in addition, operation such as jam removal from the front can be performed at only one place of the unit without inspecting several places according to indication of jam position, etc., of the machine. Thus, the effect of the third aspect of the invention is produced and the effect of being able to perform operation such as jam removal easily, rapidly, and comfortably is also produced.

According to the fifth aspect of the invention, in addition to the effects of the third and fourth aspects of the invention, operation such as jam removal in the upper portion can be executed easily and rapidly by opening the front door and drawing out the unit and operation such as jam removal in the lower portion can be executed easily and rapidly by opening the side door.

According to the sixth aspect of the invention, the sections are placed whereby the apparatus can be installed adjoining walls at corners of a room and moreover can be miniaturized without lowering operability of jam removal, image quality, or image formation productivity.

What is claimed is:

1. An image formation apparatus for transferring an image provided by developing an electrostatic latent image formed on a photosensitive body to a sheet and discharging the sheet to an outlet made in one side face of an apparatus main unit, the apparatus main unit having another side face in opposing relation to said one side face, said image formation apparatus comprising:

first storage means disposed in a lower portion of said apparatus main unit for storing the sheet;

first taking-out means for taking out the sheet from said first storage means in a direction toward said one side face;

first transport means for transporting the sheet taken out by said first taking-out means in a direction toward said another side face of the apparatus main unit; and main transport means disposed in an upper portion of said apparatus main unit for transporting the sheet from a downstream end of said first transport means to said outlet made in said one side face of the apparatus main unit to form an image on the sheet facing a photosensitive face of said photosensitive body, wherein an opening/closing section is disposed in a front face and said one side face of the apparatus main unit to access a sheet transport channel including said first taking-out means, said first transport means, and said main transport means.

2. The image formation apparatus of claims 1, further comprising:

second storage means disposed in the apparatus main unit toward said another side face above said first storage means for storing sheets of a different size than sheets stored in said first storage means; and second taking-out means for taking out a sheet in said second storage means in a direction toward said one side face and sending the sheet downstream of said first transport means.

3. The image formation apparatus of claim 1, further comprising:

reversing transport means branching from downstream of said main transport means and being disposed downstream along said one side face for reversing a sheet having a first side on which an image is formed in order to support an image on a second side of the sheet; and second transport means for sending the sheet reversed by said reversing transport means to an upstream end of said main transport means in a direction of said another side face.

4. The image formation apparatus of claim 1, wherein a space for jam removal is provided between a postprocessing device being connected to said outlet and placed forward of a discharge direction of the sheet and said one side face.

5. An image formation apparatus for transferring an image formed on a photosensitive body to a sheet for forming an image and discharging the sheet on which the image is formed to an outlet made in one side face of an apparatus main unit, the apparatus main unit having another side face in opposing relation to said one side face, said image formation apparatus comprising:

storage means for storing sheets;

taking-out means for taking out a sheet from said storage means in a direction toward said one side face;

first transport means for transporting the sheet taken out by said taking-out means in a direction toward said another side face of the apparatus main unit;

resist means for turning the sheet transported on said first transport means in a direction toward said one side face and positioning the sheet with respect to the photosensitive body; and main transport means for transporting the sheet from said resist means to the outlet made in said one side face in order to perform transferring and discharging the sheet to said outlet.

6. The image formation apparatus of claim 5, further comprising:

reversing transport means branching from said main transport means and being disposed along said one side face for transporting the sheet from said main transport means in order to reverse an image formation side of the sheet having a first side on which an image is formed; and second transport means for transporting the sheet from said reversing transport means to said resist means.

7. The image formation apparatus of claim 6, wherein said first transport means is combined with said second transport means.

8. The image formation apparatus of claim 5, wherein said resist means comprises:

a turn transport passage for turning from a connection part to a downstream end of said first transport means to connection of an upstream end of said main transport means in a half circumference like configuration;

a first roll being disposed downstream of said turn transport passage for aligning a sheet for the transferring of an image to the sheet;

a second roll being disposed upstream of said turn transport passage for sending a sheet fed into said turn transport passage to a loop formation area opposite to a resist position near said first roll;

detection means being disposed near the resist position for detecting a tip of a sheet; and baffle means taking a first position for sending the sheet to the resist position in a half circumference like configuration along said turn transport passage until said detection means detects the tip of the sheet and taking a second position for opening a transport passage of a portion of the loop formation area at least during loop formation so that the sheet makes a loop in the loop formation area when said detection means detects the tip of the sheet.

9. An image formation apparatus for transferring an image formed on a photosensitive body to a sheet for forming an image and discharging the sheet on which the image is formed to an outlet made in one side face of an apparatus main unit, the apparatus main unit having another side face in opposing relation to said one side face, said image formation apparatus comprising:

storage means for storing sheets;

taking-out means for taking out a sheet from said storage means in a direction toward said one side face;

first transport means for transporting the sheet taken out by said taking-out means in a direction toward said another side face of the apparatus main unit;

resist means for turning the sheet transported on said first transport means toward the direction of said one side face and positioning the sheet with respect to the photosensitive body; and main transport means for transporting the sheet from said resist means to the outlet made in said one side face and discharging the sheet to said outlet and;

a unit structure into which are disposed said first transport means, said resist means, and said main transport means; and drawing-out means for drawing out said unit structure from the apparatus main unit in a direction toward a front face of the apparatus main unit.

10. The image formation apparatus of claim 9, wherein said unit structure further comprises:

reversing transport means branching from downstream of said main transport means and being disposed along said one side face for transporting the sheet from said main transport means in order to reverse an image formation side of the sheet; and second transport means for transporting the sheet from said reversing transport means to said resist means.

11. The image formation apparatus of claim 10, wherein said first transport means, said main transport means, and said reversing transport means include a transport passage for carrying sheets, one or more pairs of rolls between which a sheet is sandwiched for sending the sheet are disposed along a sheet flow on the transport passage of said first transport means and said reversing transport means, wherein inner ones of said rolls being fixed to said unit structure and outer rolls being able to be attached to and detached from the inner rolls for opening and closing said transport passage for carrying sheets to an outside of said unit structure.

12. The image formation apparatus of claim 11, wherein said second transport means comprises a transport passage for carrying sheets, said main transport means includes:

transfer means for performing the transferring of a sheet upstream;

separation means for separating a sheet to which an image is transferred by said transfer means from the photosensitive body;

fixing means for fixing the image formed on the sheet separated by said separation means; and after-separation transport passage for transporting the separated sheet between said separation means and said fixing means, and said main transport means is disposed in a subunit frame so that said transfer means, said separation means, and said after-separation transport passage pivot to an inside of said unit structure so as to be set apart from the photosensitive body when said unit structure is drawn out from said apparatus main unit, and pivot to an outside of said unit structure after said unit structure is drawn out from said apparatus main unit, and one or more pairs of rolls for sending sheets are disposed on the transport passage of said second transport means, an inner transport passage of said second transport means containing inner ones of said pairs of rolls being fixed to said unit structure and an outer transport passage of said second transport means containing outer ones of said pairs of rolls being able to pivot in one or more directions relative to a transferred sheet.

13. The image formation apparatus of claim 10, wherein said first transport means, said main transport means, and said reversing transport means contain a transport passage for carrying sheets, said second transport means branches downstream of the transport passage of said reversing transport means and merges with downstream the transport passage of said first transport means, and the transport passage of said main transport means, a transport passage portion before a branching on the transport passage of said reversing transport means, and a transport passage of said second transport means and the transport passage of said first transport means are disposed in a Z letter configuration.

14. The image formation apparatus of claim 9, further comprising:

means for controlling transport of a sheet from taking out a sheet from said storage means to discharging the sheet, wherein when sheet transport is interrupted due to an error, said means for controlling transport of a sheet prohibits any further sheet transport in said unit structure and the apparatus main unit.

15. The image formation apparatus of claim 9, wherein said unit structure comprises said first transport means, said resist means, and said main transport means disposed in a frame, said drawing-out means for drawing out said unit structure is a rail being disposed in the apparatus main unit and said frame for sliding the frame back and forth with respect to the apparatus main unit, and positioning between said resist means and the photosensitive body is performed by fitting pins disposed in said unit structure into holes made in a cabinet of the apparatus main unit.

16. The image formation apparatus of claim 15, wherein said unit structure includes fixing means for fixing an image on a sheet after the transferring, said fixing means being disposed with play in said unit structure, and positioning is performed by fitting pins disposed in a cabinet of said fixing means into holes made in the cabinet of the apparatus main unit.

17. The image formation apparatus of claim 16, wherein said resist means and said fixing means are attached as subunits detachable from the frame of said unit structure, and the subunit of said fixing means is disposed with play detachably with pins disposed upward at attachment positions of the frame of said unit structure and holes made in a lower part of the cabinet of said fixing means.

18. An image formation apparatus for transferring an image formed on a photosensitive body to a sheet for forming an image and discharging the sheet on which the image is formed to an outlet made in one side face of an apparatus main unit the apparatus main unit having another side face in opposing relation to said one side face, said image formation apparatus comprising:

means for storing sheets;

taking-out means for taking out a sheet from said means for storing sheets in a direction toward said one side face;

first transport means for transporting the sheet taken out by said taking-out means in a direction toward said another side face of the apparatus main unit;

resist means for turning the sheet transported on said first transport means toward the direction of said one side face and positioning the sheet with respect to the photosensitive body;

main transport means for transporting the sheet from said resist means to the outlet made in said one side face and discharging the sheet to said outlet;

reversing transport means branching from said main transport means and being disposed along said one side face for transporting the sheet from said main transport means in order to reverse an image formation side of the sheet;

second transport means for transporting the sheet from said reversing transport means to said resist means; and means for drawing out a unit structure from the apparatus main unit in a direction toward a front face of the apparatus main unit, wherein said unit structure is disposed in an upper portion of the apparatus main unit and a front door is disposed on the front face of the apparatus main unit in order to remove a jammed sheet occurring in the upper portion of the apparatus main unit, said means for storing sheets includes one or more storage means disposed in a lower portion of the apparatus main unit and said taking-out means is disposed corresponding to said storage means and includes handling means for sending out stored sheets one at a time in sequence toward said one side face and a paper feed transport passage for sending upward the sheets sent out from said handling means to said first transport means, and a side door disposed on said one side face in order to remove a jammed sheet occurring in said taking-out means in the lower portion of the apparatus main unit or said reversing transport means.

19. The image formation apparatus of claim 18, wherein said reversing transport means comprises:

an upper reversing transport passage for carrying sheets in said unit structure; and a lower reversing transport passage being connected to said upper reversing transport passage and extending to the outside of said unit structure, and said side door comprises:

an outer door for removing a jammed sheet in a transport passage of said reversing transport means; and an inner door for removing a jammed sheet in said paper feed transport passage.

20. A The image formation apparatus of claim 19, wherein said paper feed transport passage is disposed in a vertical direction and comprises one or more pairs of rolls disposed along a sheet flow, inner ones of said rolls being disposed in the apparatus main unit and outer ones being disposed in said second inner door.

21. The image formation apparatus of claim 20, wherein sandwich means for sandwiching a sheet temporarily in a state in which the sheet is dangled downward is disposed downstream of said reversing transport means disposed in said unit structure, and a space for temporarily storing the sheet sandwiched by said sandwich means is formed between said outer door and said inner door as a lower transport passage of said reversing transport means in a state in which said outer door and said inner door are closed.

22. The image formation apparatus of claim 18, further comprising:

second storage means disposed toward said another side face between said first transport means in an upper portion of the apparatus main unit and said storage means in the lower portion of the apparatus main unit for storing sheets of a different size than sheets stored in said storage means; and second taking-out means for taking out a sheet from said second storage means in a direction toward said one side face and sending the sheet to said first transport means.

23. The image formation apparatus of claim 22, wherein said resist means comprises:

a turn transport passage for turning from a connection part to a downstream end of said first transport means to connection of an upstream end of said main transport means in a half circumference like configuration; and a resist position for positioning a sheet for transferring of an image to the sheet near a downstream end of said turn transport passage, said second taking-out means comprises:

second handling means for sending out stored sheets one at a time in sequence toward said one side face; and a second paper feed transport passage being shaped in a half circumference like configuration in a direction opposite to said turn transport passage for sending upward the sheets sent out from said second handling means to said first transport means, wherein said turn transport passage, a passage of said first transport means and said second paper feed transport passage is continuously formed in an S like configuration.

24. The image formation apparatus of claim 22, wherein at least one of said storage means and said second storage means stores different types of sheets in corresponding placement means and at least one of said taking-out means and said second taking-out means sends the sheets placed in the corresponding placement means one at a time in sequence.

25. An image formation apparatus wherein operation portions for performing operation for said image formation apparatus from an outside of the apparatus are put together on three operation faces including a top face, a front, and either a left or right side face of said apparatus, said image formation apparatus comprising:

an original document placement section disposed on the top face;

a section for reading an original document placed on said original document placement section;

an image formation process section for forming an image read through said original document read section on a sheet and transporting the sheet in an almost horizontal direction;

a registration section containing a reversing transport passage for diverting a transport direction of a sheet to one side face used as an operation face from one side face set to a non-operation face, said registration section for positioning the diverted sheet and then sending it to said image formation process section;

a sheet transport passage containing a reversing transport passage for diverting a transport direction of a sheet to the one side face set to the non-operation face from the one side face used as the operation face, said sheet transport passage for sending the diverted sheet to said registration section; and a section for storing sheets fed into said sheet transport passage, wherein a sheet sending out direction from said sheet storage section and a sheet discharge direction to the outside of said apparatus are set to the one side face used as the operation face.

26. The image formation apparatus of claim 25, further comprising:

a second sheet storage section being disposed between said registration section and said section for storing sheets for storing sheets of a different size than sheets stored in said section for storing sheets.

27. The image formation apparatus of claim 26, wherein the sheet transport passage from said section for storing sheets and said second sheet storage section to a sheet outlet of said apparatus is shaped substantially in an S like configuration.

28. The image formation apparatus of claim 25, further comprising:

an image formation side reversing transport passage being disposed at a position opposed to said sheet transport passage along the one side face used as the operation face for reversing a sheet transported from said image formation process section, the sheet having a single side on which an image is formed; and transport passage being disposed between said sheet transport passage and said image formation process section for transporting the sheet from said image formation side reversing transport passage to said registration section.

29. The image formation apparatus of claim 25, wherein said image formation process section comprises:

transfer means for transferring an image to the sheet;

fixing means for fixing the image on the sheet; and a transport passage for transporting the sheet through the image formation process section, and said transfer means, said fixing means, said transport passage, said registration section, and a part of said sheet transport passage are put into a unit, and wherein said fixing means and said registration section are positioned detachably from said unit as a subunit.

* * * * *